US008943967B2

(12) United States Patent
Hans et al.

(10) Patent No.: US 8,943,967 B2
(45) Date of Patent: Feb. 3, 2015

(54) METHOD OF MOUNTING AND REGISTERING A PRINTING PLATE ON A PLATE CYLINDER OF A MULTI-COLOR OFFSET PRINTING PRESS

(75) Inventors: Michael Hans, Ottawa (CA); Patrick Kress, Bad Mergentheim-Edelfingen (DE); Volkmar Rolf Schwitzky, Wurzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 14/127,143

(22) PCT Filed: Jul. 2, 2012

(86) PCT No.: PCT/IB2012/053357

§ 371 (c)(1),
(2), (4) Date: Feb. 19, 2014

(87) PCT Pub. No.: WO2013/001518

PCT Pub. Date: Jan. 3, 2013

(65) Prior Publication Data

US 2014/0238257 A1 Aug. 28, 2014

(30) Foreign Application Priority Data

Jun. 30, 2011 (EP) ..... 11172072

(51) Int. Cl.
*B41L 3/02* (2006.01)
*B41F 27/00* (2006.01)

(52) U.S. Cl.
CPC ..... *B41F 27/005* (2013.01); *B41F 24/1231* (2013.01); *B41P 2227/42* (2013.01)
USPC ..... 101/486; 101/383

(58) Field of Classification Search
USPC ..... 101/486
See application file for complete search history.

(56) References Cited

U.S. PATENT DOCUMENTS

| | | | | |
|---|---|---|---|---|
| 4,489,653 | A * | 12/1984 | Cappel et al. | 101/415.1 |
| 5,359,933 | A * | 11/1994 | Blaser et al. | 101/415.1 |
| 5,398,609 | A * | 3/1995 | Stiel | 101/415.1 |
| 6,101,939 | A | 8/2000 | Giori et al. | |
| 6,474,234 | B1 * | 11/2002 | Rothaug | 101/415.1 |
| 6,736,065 | B2 * | 5/2004 | Naniwa et al. | 101/415.1 |
| 6,901,858 | B2 * | 6/2005 | Koppelkamm | 101/415.1 |

(Continued)

FOREIGN PATENT DOCUMENTS

| | | |
|---|---|---|
| DE | 42 39 089 A1 | 11/1993 |
| DE | 0 579 017 A1 | 1/1994 |

(Continued)

*Primary Examiner* — Anthony Nguyen
(74) *Attorney, Agent, or Firm* — Mattingly & Malur, PC

(57) ABSTRACT

A method of mounting and adjusting a printing plate on a plate cylinder of a multicolor offset printing press is described. The printing plate is clamped between front and rear clamping bars, the rear clamping bar being movable under the application of a tensioning force and occupying, upon clamping of the trailing end of the printing plate, a tension-release position. Tensioning of the printing plate is carried out by initially applying a nominal tensioning force to the rear clamping bar. A print register of the tensioned printing plate is then measured and compared to a target print register to determine a corrected tensioning position of the rear clamping bar corresponding to the target print register. The tension of the printing plate is thereafter released. The correct tensioning position is set as new reference position of the rear clamping bar before or after tensioning again the printing plate.

15 Claims, 20 Drawing Sheets

(56) References Cited

U.S. PATENT DOCUMENTS

| | | | |
|---|---|---|---|
| 2008/0271620 | A1 | 11/2008 | Hoier et al. |
| 2009/0007807 | A1 | 1/2009 | Schaede et al. |
| 2009/0025594 | A1 | 1/2009 | Schaede et al. |

FOREIGN PATENT DOCUMENTS

| | | | |
|---|---|---|---|
| DE | 195 11 956 | A1 | 10/1996 |
| DE | 102005061453 | A1 | 6/2007 |
| DE | 102005061460 | A1 | 6/2007 |
| EP | 0 581 212 | A1 | 2/1994 |
| EP | 0 711 664 | A1 | 5/1996 |
| EP | 0 933 204 | A1 | 8/1999 |
| EP | 0 949 069 | A | 10/1999 |
| WO | 2007/042919 | A2 | 4/2007 |
| WO | 2007/105059 | A1 | 9/2007 |
| WO | 2007/105061 | A1 | 9/2007 |

* cited by examiner

METHOD OF MOUNTING AND REGISTERING A PRINTING PLATE ON A PLATE CYLINDER OF A MULTI-COLOR OFFSET PRINTING PRESS

This application is the U.S. National Phase, under 35 USC 371, of PCT/IB2012/053357, filed Jul. 2, 2012; published as WO 2013/001518A1 on Jan. 3, 2013 and claiming priority to EP 111 72072.8, filed Jun. 30, 2011, the disclosures of which are expressly incorporated herein by reference.

TECHNICAL FIELD

The present invention generally relates to the mounting and adjusting of printing plates on corresponding plate cylinders of multicolour offset printing presses. The invention more specifically relates to such mounting and adjusting of printing plates on multicolour offset printing presses of the type comprising multiple plate cylinders transferring inks to a common blanket cylinder. The invention is in particular applicable to so-called Simultan-type offset printing presses for the simultaneous recto-verso printing of sheet or web material as used in the context of the production of security documents, such as banknotes.

BACKGROUND OF THE INVENTION

The "Simultan" process is a distinctively different and secure offset printing process created by the Applicant more than five decades ago, which process is widely applied in the security printing industry. This process is increasingly being challenged by the ever-increasing quality of readily available counterfeit methods of desktop publishing and commercial printing.

The Simultan process is radically different form commercial offset printing. Commercial offset printing presses create multicolour images using a number of separate printing units through which the paper runs in succession. The paper is travelling from one unit to the next to collect all separate colours one after the other on the substrate. However, the substrate is a flexible, living material that warps with pressure, humidity and temperature. Even with the best material these variations vary at random. Consequently colour to colour registration at the end of the printing process is slightly different for different areas of the print. Colour images printed on commercial offset printing presses are typically generated by combinations of microscopic dot arrays, which are sufficiently forgiving for these variations. In contrast, security prints produced on security offset printing presses, especially by way of the above-mentioned Simultan process, require a perfect plate to plate registration on the entire sheet. Here, the specific design of the Simultan offset printing press (as sold by the Applicant under the registered trade name Super Simultan®) comes into play. Indeed, rather than being based on the use of separate printing units as in the above-described commercial printing presses, the Simultan offset printing press (an example of which is illustrated in FIGS. 1A, 1B and 2 hereof) is based on a different principle, namely the collecting of the different colour images from the printing plates on a common blanket cylinder. In the Simultan press, such principle is actually applied simultaneously on both sides of the printing material, i.e. two blanket cylinders (one for each side) collect the colour patterns of the corresponding plate cylinders carrying the printing plates on the recto side and verso side respectively. With this principle, the precision of the registration between colours is no longer dependent on the fluctuations of substrates but only from the high precision mechanics of the press (gears, frames, bearings, cylinders, etc.) and the reproduction and mounting of the printing plates.

It is not enough to have a precise press, but all elements in the process must be equally precise. While the Simultan process exhibits technically unmatched printing performance, there is still a need to improve this process and achieve even higher printing accuracy and colour registration. In order to keep its leading edge in security printing and to maintain a safe distance from the existing and ever-evolving threats, the whole process, from the origination through plate-making and make-ready in the press, has been reviewed and upgraded with a view to provide unprecedented precision in an easy-to-master way and open the door to an entirely new class of security features to the security printing industry.

SUMMARY OF THE INVENTION

A general aim of the invention is thus to improve the known methods with a view to achieve and ensure high print register in multicolour offset printing presses, especially in offset printing presses of the type comprising multiple plate cylinders transferring inks to a common blanket cylinder, such as and in particular Simultan-type offset printing presses for the simultaneous recto-verso printing of sheet or web material.

More particularly, an aim of the invention is to improve the known methods of mounting and adjusting printing plates on plate cylinders of multicolour offset printing presses.

Yet another aim of the invention is to improve such methods with a view to master the entire process, from origination through plate-making and make-ready in the press, and ensure that influences on plate registration, and thereby print register are almost entirely eliminated.

These aims are achieved thanks to the solution defined in the claims.

More precisely, there is provided a method of mounting and adjusting a printing plate on a plate cylinder of a multicolour offset printing press, the method comprising the following steps:

a) clamping a leading end of the printing plate in a front clamping bar of the plate cylinder;
b) wrapping the printing plate around the circumference of the plate cylinder;
c) clamping a trailing end of the printing plate in a rear clamping bar of the plate cylinder, which rear clamping bar is movable under the application of a tensioning force and occupies, upon clamping of the trailing end of the printing plate, a tension-release position;
d) tensioning the printing plate by applying a nominal tensioning force to the rear clamping bar, thereby causing the rear clamping bar to move from the tension-release position to a nominal tensioning position;
e) setting and storing the nominal tensioning position as a reference position of the rear clamping bar;
f) measuring a print register of the tensioned printing plate;
g) comparing the measured print register of the tensioned printing plate with a target print register and determining a corrected tensioning position of the rear clamping bar corresponding to the target print register;
h) releasing the tension of the printing plate;
i) setting the previously-determined corrected tensioning position as new reference position of the rear clamping bar before or after tensioning again the printing plate; and
j) if necessary, repeating steps f) to i) until the measured print register matches the target print register.

In accordance with a first embodiment of the invention, step i) includes setting the previously-determined corrected tensioning position as new reference position of the rear clamping bar before tensioning again the printing plate by applying a tensioning force to the rear clamping bar thereby causing the rear clamping bar to move to the new reference position.

In accordance with a second embodiment of the invention, step i) includes tensioning again the printing plate by applying a tensioning force to the rear clamping bar thereby causing the rear clamping bar to move to a correcting position before setting the previously-determined corrected tensioning position as new reference position of the rear clamping bar.

Thanks to this method, correct and precise mounting of the printing plates on the plate cylinders of the printing press can be ensured with unprecedented ease of operation.

Furthermore, undesired and irreversible plate distortions that would often occur as a result of the prior plate mounting procedures are now a story of the past.

According to another aspect of the invention, variations in the handling of the printing plates are prevented thanks to a semi-automatic plate clamping procedure limiting the number of manual operations from the operator and ensuring unmatched repeatability.

Further advantageous embodiments of the invention form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The invention will be described hereinafter in the context of a multicolour sheet-fed offset printing press for the simultaneous recto-verso printing of sheets as used in the context of the production of security documents, such as banknotes. Such a security printing press is commonly referred to as a so-called "Simultan-type" (or simply "Simultan") security printing press, as printing of the sheets is carried out on both sides of the sheets in a simultaneous manner. Such a Simultan-type printing press is sold by the instant Applicant under the registered trademark "Super Simultan®".

Figure 1A:
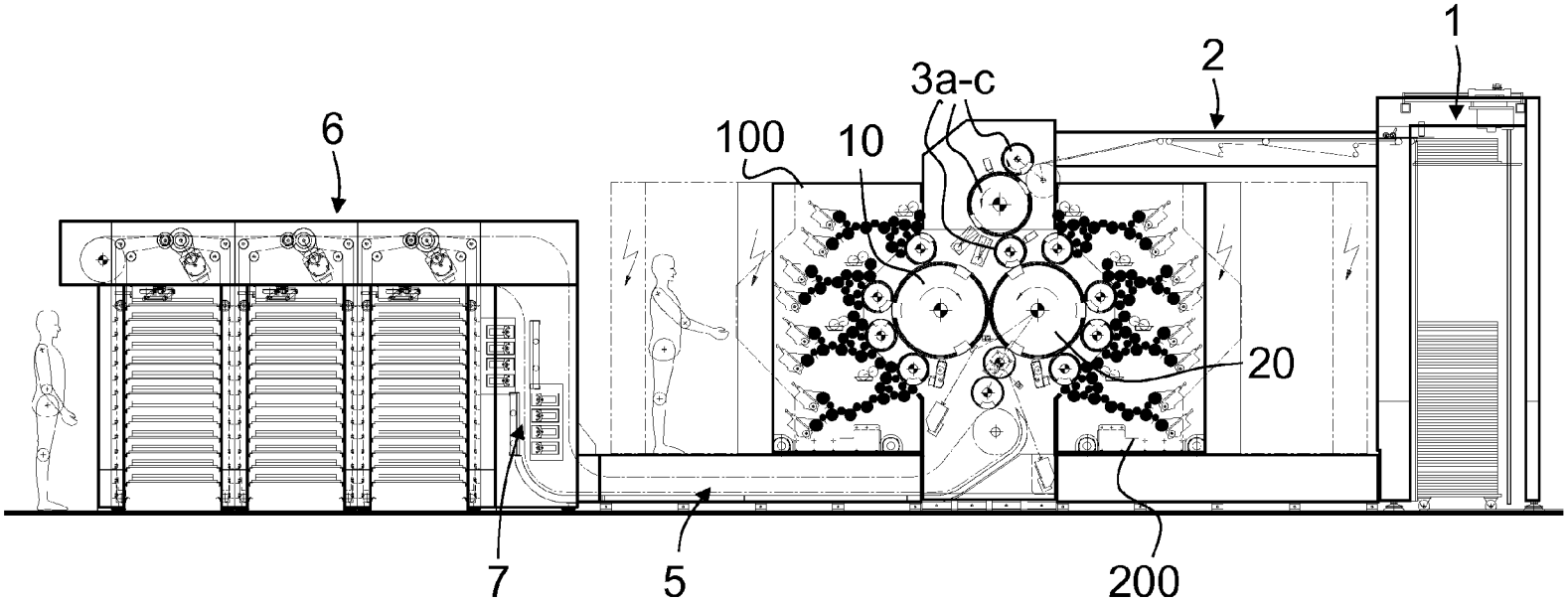
FIG. 1A is a schematic side view of a known Simultan-type multicolor offset printing press for the simultaneous recto-verso printing of sheets as used for the production of security documents, such as banknotes.
Figure 1B:
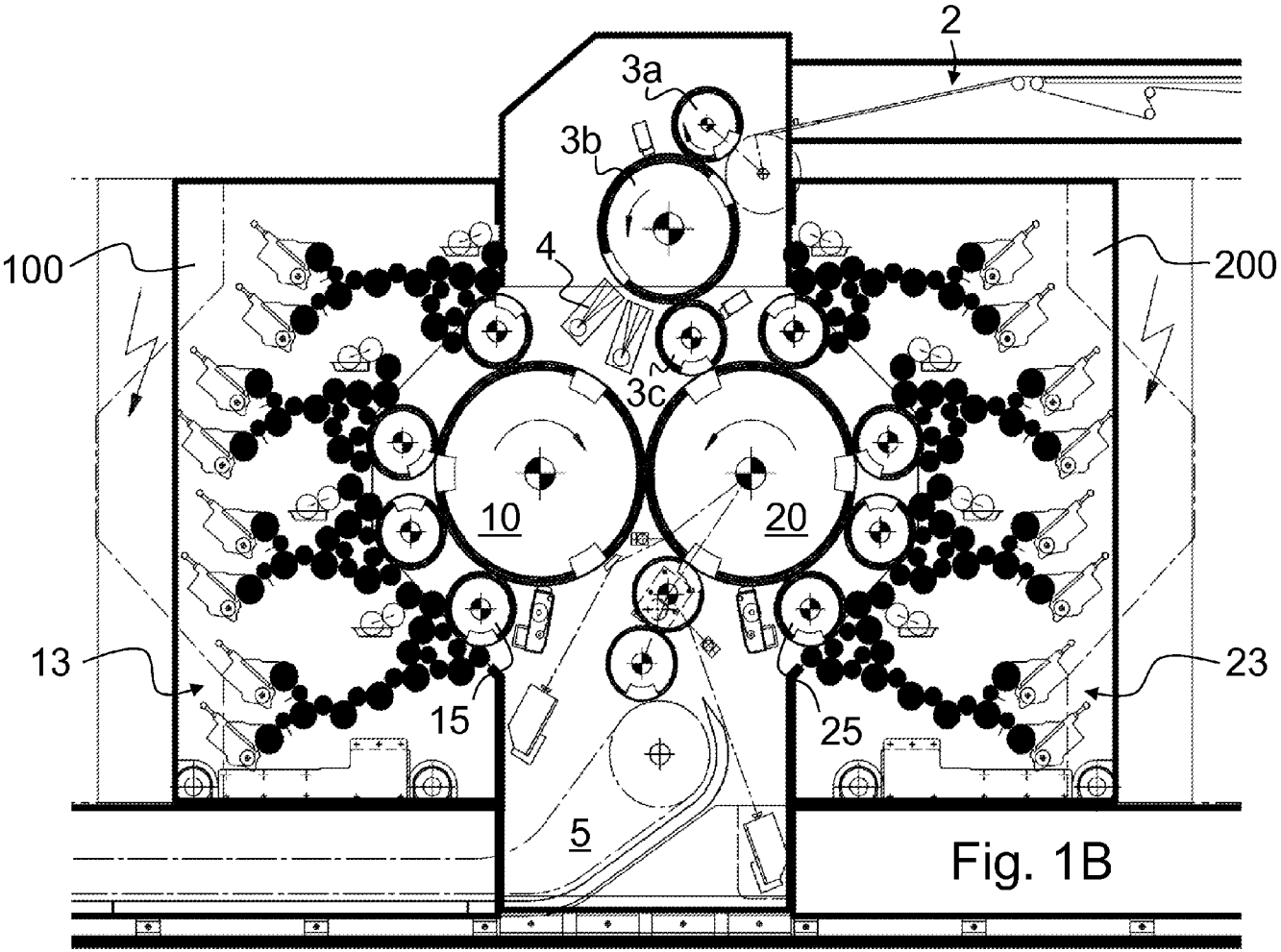
FIG. 1B is an enlarged side view of the printing group of the printing press of FIG. 1A

The security printing press illustrated in FIGS. 1A and 1B is already described in International application No. WO 2007/105059 A1 (and corresponding US publication No. US 2009/0025594 A1), which publication is incorporated herein by reference in its entirety. Further information about such printing presses is also disclosed in European patent No. EP 0 949 069 B1 (and corresponding U.S. Pat. No. 6,101,939) and International applications Nos. WO 2007/042919 A2 (and corresponding US publication No. US 2008/0271620 A1) and WO 2007/105061 A1 (and corresponding US publication No. US 2009/0007807 A1). All of the above-listed applications are incorporated herein by reference in their entirety.

Figure 2:
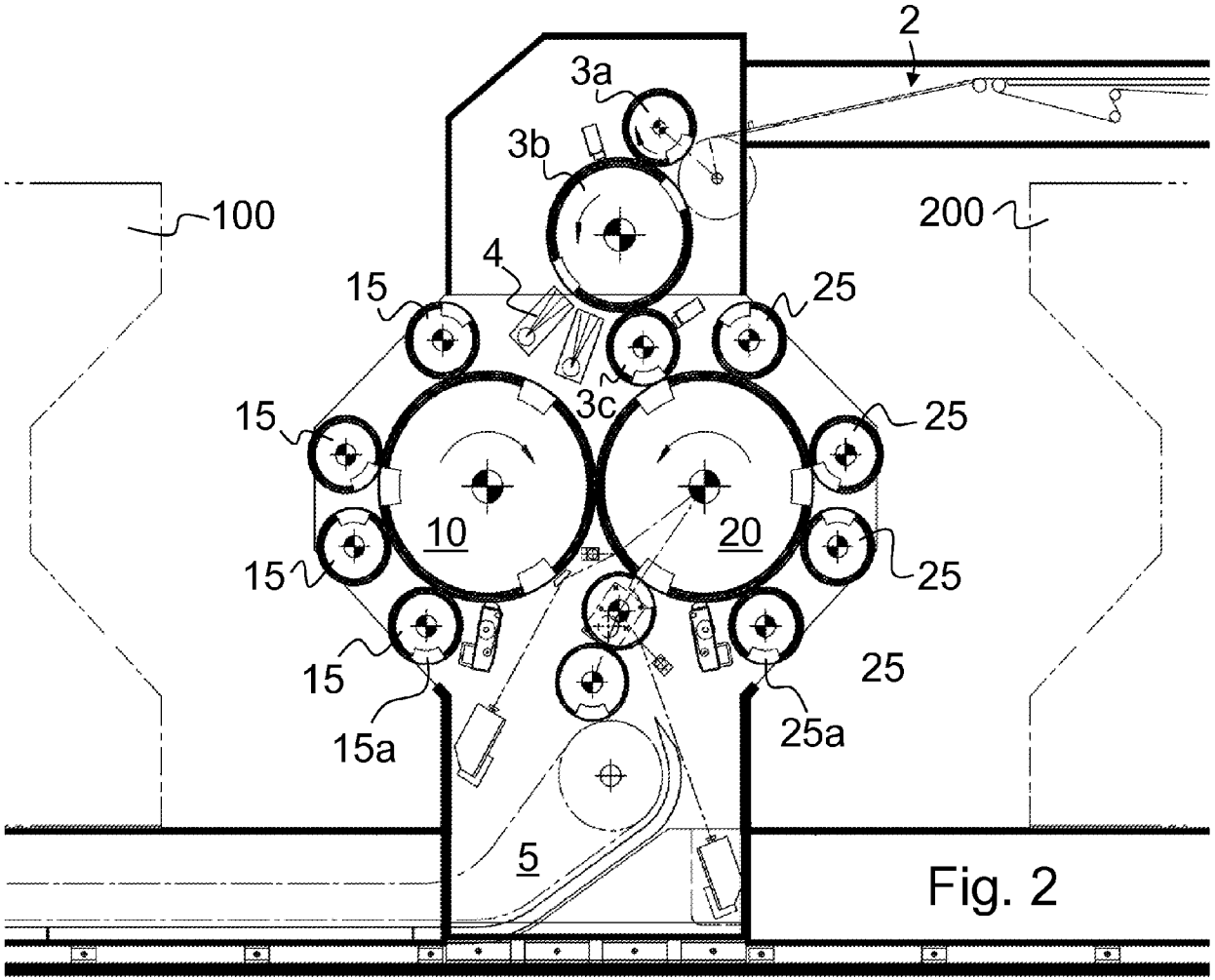
FIG. 2 is a schematic side view of the printing press of FIGS. 1A and 1B with mobile inking carriages of the press being moved to retracted positions allowing access to the various plate cylinders of the printing press.

The printing group of the press, which is adapted in this case to perform simultaneous recto-verso offset printing of the sheets, comprises in a conventional manner two blanket cylinders (or impression cylinders) 10, 20 rotating in the direction indicated by the arrows and between which the sheets are fed to receive multicolour impressions. In this example, blanket cylinders 10, 20 are three-segment cylinders. The blanket cylinders 10, 20 receive and collect different ink patterns in their respective colours from plate cylinders 15 and 25 (four on each side) which are distributed around a portion of the circumference of the blanket cylinders 10, 20. These plate cylinders 15 and 25, which each carry a corresponding printing plate, are themselves inked by corresponding inking units 13 and 23, respectively, in a manner known in the art. The two groups of inking units 13 and 23 are advantageously placed in two inking carriages 100, 200 that can be moved toward or away from the centrally-located plate cylinders 15, 25 and blanket cylinders 10, 20. FIG. 2 in particular shows the printing press with the movable inking carriages 100, 200 moved to retracted positions during maintenance operations, including for the purpose of changing and mounting printing plates on the plate cylinders 15, 25.

Sheets are fed from a feeding station 1 located next to the printing group (on the right-hand side in the Figures) onto a feeder table 2 and then to a succession of transfer cylinders 3*a*, 3*b*, 3*c* (three cylinders in this example) placed upstream of the blanket cylinders 10, 20. While being transported by the transfer cylinder 3*b*, the sheets may optionally receive a first impression on one side of the sheets using an additional printing group (not illustrated) as described in European patent No. EP 0 949 069 B1 and International application No. WO 2007/042919 A2, transfer cylinder 3*b* fulfilling the additional function of impression cylinder in such a case. In case the sheets are printed by means of the optional additional printing group, these are first dried by a drying or curing unit 4 before being transferred to the blanket cylinders 10, 20 for simultaneous recto-verso printing.

In the example of FIGS. 1A and 1B, the sheets are transferred onto the surface of blanket cylinder 20 where a leading edge of each sheet is held by appropriate gripper means located in cylinder pits between each segment of the blanket cylinder. Each sheet is thus transported by the blanket cylinder 20 to the printing nip between the blanket cylinders 10 and 20 where simultaneous recto-verso printing occurs. Once printed on both sides, the printed sheets are then transferred as known in the art to a chain gripper system 5 for delivery in a sheet delivery station 6 comprising multiple delivery piles (three in this example).

The chain gripper system 5 typically comprises a pair of chains holding a plurality of spaced-apart gripper bars (not shown) each provided with a series of grippers for holding a leading edge of the sheets. As shown in FIG. 1A, the chain gripper system 5 extends from below the two blanket cylinders 10, 20, through a floor part of the printing press and on top of the three delivery piles of the delivery station 6. The gripper bars are driven along this path in a clockwise direction, the path of the chain gripper system 5 going from the printing group to the sheet delivery station 6 running below the return path of the chain gripper system 5. A drying/curing system 7 is disposed along the path of the chain gripper system 5 in order to dry both sides of the sheets, drying being performed using infrared lamps and/or UV lamps depending on the type of inks used. In this example, the drying system 7 is located at a vertical portion of the chain gripper system 5 where the gripper bars are led from the floor part of the printing press to the top of the sheet delivery station 6.

In the example of FIGS. 1A, 1B and 2, first and second transfer cylinders (not referenced), such as suction drums or cylinders, are interposed between the chain gripper system 5 and the blanket cylinder 20 so that printed sheets can be taken away from the surface of the blanket cylinder 20 and then transferred in succession to the first transfer cylinder, to the second transfer cylinder and finally to the chain gripper system 5. These first and second transfer cylinders are designed to carry out inspection of the sheets on the recto and verso sides as described in International application No. WO 2007/105059 A1. Whether or not these first and second transfer cylinders are provided does not impact on the subject-matter of the instant invention and such cylinders may accordingly be omitted.

Turning to FIG. 2, when new printing plates have to be mounted on the printing press, the inking carriages 100, 200 are first retracted to maintenance positions as depicted by dashed lines in FIG. 2 to provide access for an operator to work on the various plate cylinders 15, 25 of the printing press.

As is known in the art, each printing plate is wrapped around the corresponding plate cylinder and clamped at its leading end and trailing end by a suitable plate clamping system, which plate clamping system is located in a corresponding cylinder pit of the plate cylinder. Such cylinder pits are designated by reference numerals 15*a* and 25*a* in FIG. 2.

Figure 3:
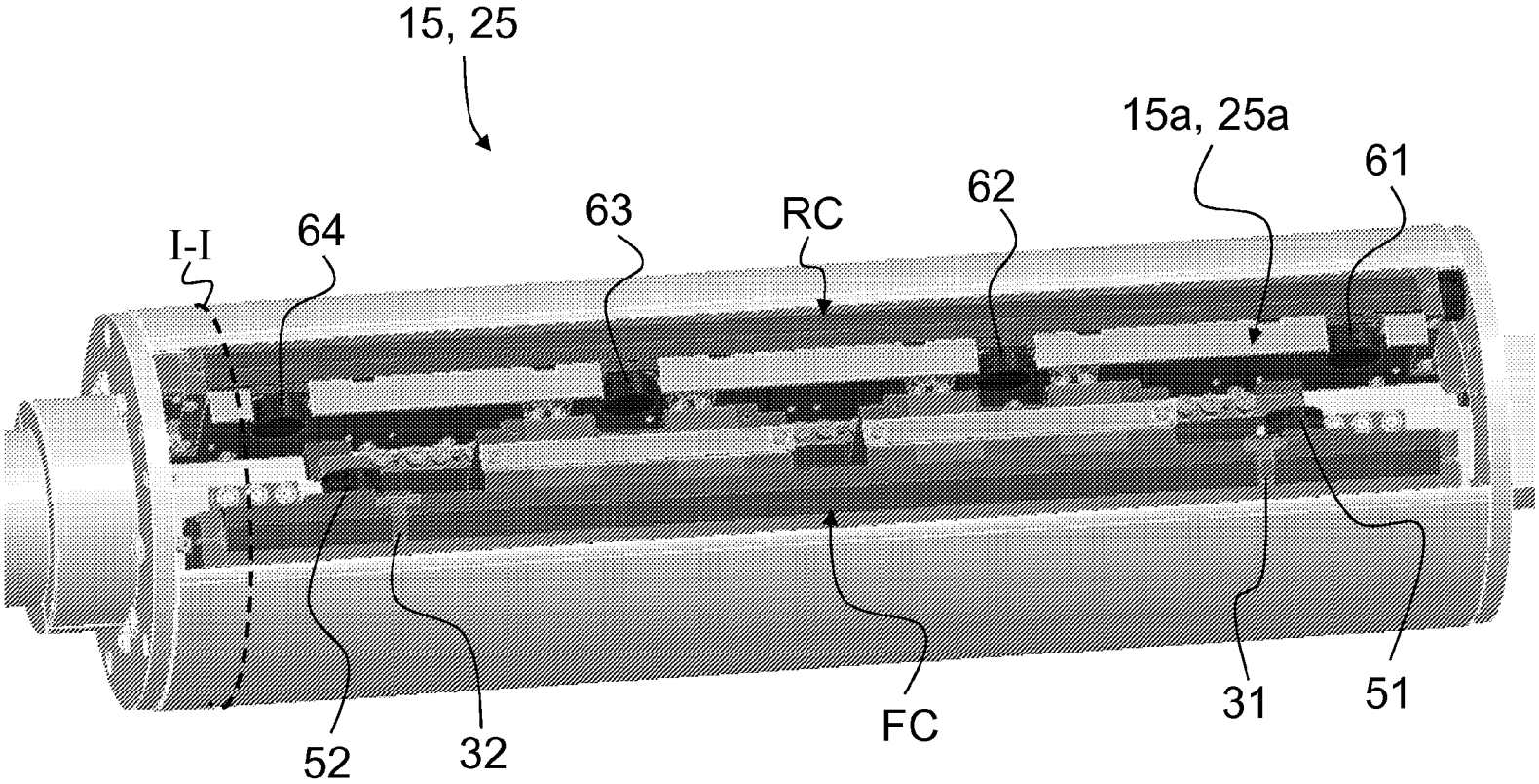
FIG. 3 is a schematic perspective view of a plate cylinder of the printing press of FIGS. 1A, 1B and 2 showing a corresponding plate clamping system located in a cylinder pit of the plate cylinder, which plate clamping system is used in the context of a first embodiment of the invention.
Figure 4:
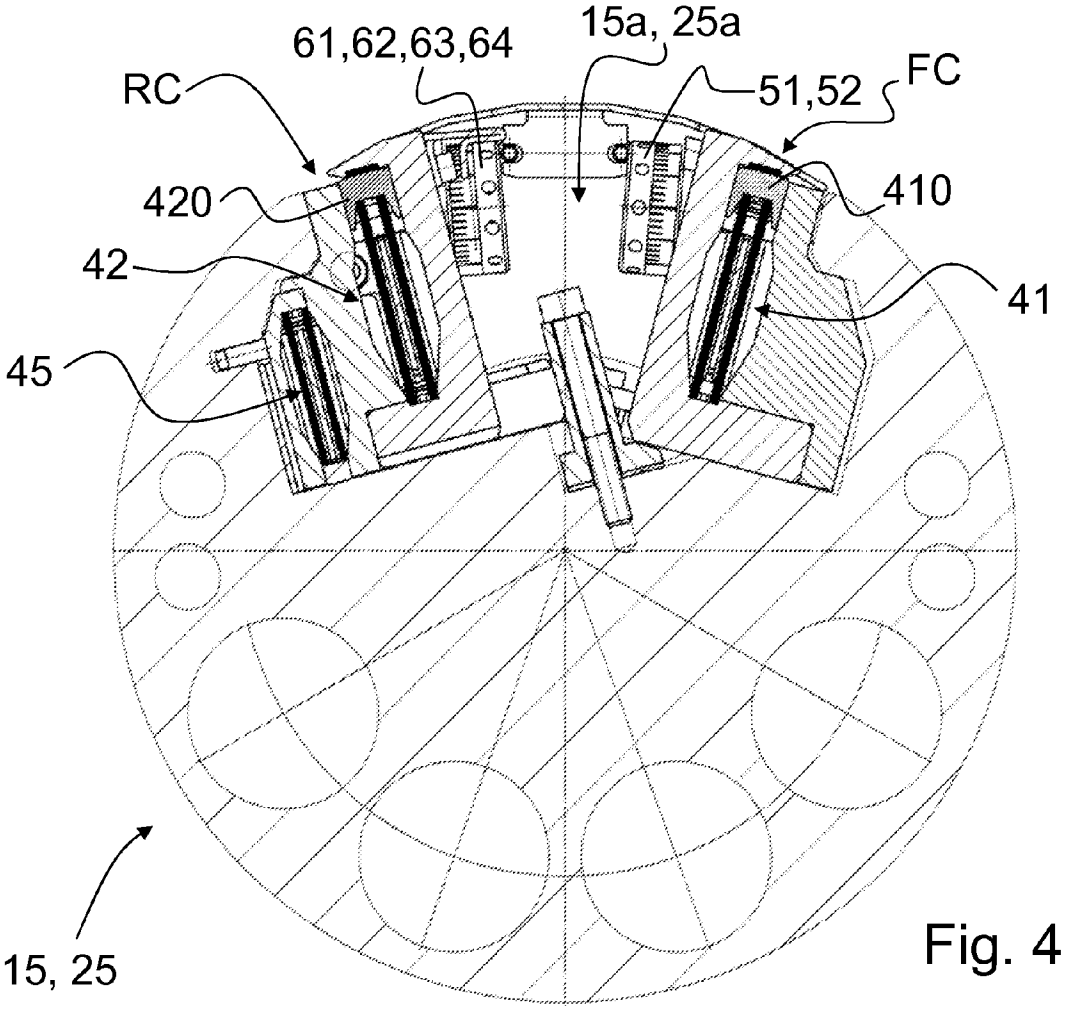
FIG. 4 is a schematic sectional view of the clamping system of FIG. 3 taken along section I-I indicated in FIG. 3.

A suitable plate cylinder and plate clamping system is illustrated in FIGS. 3 and 4. It is to be appreciated that each plate cylinder 15, 25 of the printing press exhibits an identical structure. The plate cylinder and plate clamping system of FIGS. 3 and 4 has been rethought from the ground up in order to ensure adequate and highly accurate mounting and tensioning of the printing plate.

The plate clamping system comprises a front clamping bar FC and rear clamping bar RC which are respectively designed to hold a leading end (hereinafter designated by reference LP) and a trailing end (hereinafter designated by reference TP) of the printing plate. Both clamping bars FC, RC are mounted in the cylinder pit 15*a*, 25*a* of the plate cylinder 15, 25. As is typical in the art, the front clamping bar FC is provided with a pair of register pins 31, 32 designed to cooperate with corresponding register punch holes provided at the leading end LP of the printing plate, which register pins and register punch holes ensure a defined mounting of the leading end of the printing plate in and with respect to the front clamping bar FC. The register pins 31, 32 and corresponding register punch holes (designated by references Pa and Pb) are also depicted in FIGS. 6*a* to 6*e*.

The use of register pins and register punch holes is common in the art and one may in particular refer to the disclosure of European patent applications Nos. EP 0 581 212 A1, EP 0 711 664 A1, EP 0 933 204 A1.

According to a preferred embodiment of the invention, the register pins 31, 32 each have at least one sensor element designed to indicate accurate fitting abutment of the register punch holes Pa, Pb of the printing plate against the register pins 31, 32. Such sensors are schematically illustrated in FIGS. 6*a* to 6*e* and indicated by references 31*a*, 32*a* respectively. In this way, proper insertion of the leading end LP of the printing plate in the front clamping bar FC is ensured, the front clamping bar FC being only closed upon feedback by the sensor elements 31*a*, 32*a* that the register punch holes Pa, Pb abut against the register pins 31, 32.

According to an advantageous variant of the invention, the register punch holes Pa, Pb are provided in register with a printing image imaged on the printing plate, the register punch holes Pa, Pb being punched after imaging of the printing image on the printing plate and in relation to a position of the printing image on the printing plate. High-precision punching apparatus for the punching of register punch holes in register with the printing image of the printing plate are known per se in the art. Such an apparatus is for instance available from Polygraphische innovative Technik Leipzig GmbH, or "PITSID", (www.pitsidleipzig.com) under the designation "Automatic Precision Plate Punch" ("Automatische Präzisions-Plattenstanze"), or "APP", and was developed together with the SID Leipzig (Sächsisches Institut für die Druckindustrie GmbH—www.sidleipzig.de). Similar systems are also available from LEHNER GmbH, Sensor-Systeme (www.lehner-gmbh.com). Thanks to such solutions, high register between the printing image on the printing plate and the positioning of the printing plate in accordance with the register pins and register punch holes is ensured with an accuracy of the order of a few microns.

Under normal conditions, the front clamping bar FC is acting as fixed reference for the leading end LP of the plate and is not normally adjusted in position. Nevertheless, two adjusting elements 51, 52 are provided in this example. The adjusting elements 51, 52 are located in the remaining opening of the cylinder pit 15*a*, 25*a* of the plate cylinder 15, 25, on the right-hand side and left-hand side of a rear wall portion of the front clamping bar FC (see also FIGS. 6*a* to 6*e*). In case of necessity, fine-adjustment of the position of the front clamping bar FC can be performed by way of the two adjusting elements 51, 52. Considering that lateral register is normally adjusted by a lateral positioning of the entire plate cylinder 15, 25 and that a zero position of the printing plate, in the circumferential position, is adjusted by way of a proper rotational positioning of the plate cylinder 15, 25, it suffices to provide the ability for the front clamping bar FC to be tilted towards the right or the left about a pivot axis (designated by reference O in FIGS. 6*a* to 6*e*). This being said, under normal conditions, the front clamping bar FC may remain in a fixed position and is not normally adjusted. In an alternative, it may therefore be envisaged to design the front clamping bar FC as an entirely fixed clamping bar with no adjustment ability.

The rear clamping bar RC, on the other hand, is designed to be movable along the circumferential direction and multiple adjusting elements, in this case four adjusting elements 61 to 64, are provided to allow fine adjustment of the position of the rear clamping bar RC as this will be explained hereinafter in reference to FIGS. 6*a* to 6*e*. Like the adjusting elements 51, 52, the adjusting elements 61 to 64 are distributed along the length of a rear wall portion of the rear clamping bar RC, at an outer right-hand side, center right-hand side, center left-hand side, and outer left-hand side of the rear clamping bar RC. The adjusting elements 61 to 64 (as well as adjusting elements 51, 52) can advantageously be remote-adjustable motorized adjusting elements (such as motorized adjusting screws) allowing adjustments to be carried out by an operator in a semi-automatic way from any suitable remote control console of the printing press. Upon clamping of the trailing end TP of the printing plate in the rear clamping bar RC and initial tensioning of the printing plate, the adjusting elements 61 to 64 do not abut against the rear clamping bar RC, thereby allowing the rear clamping bar RC to move freely.

Preferably, movement of the rear clamping bar RC is controlled pneumatically by way of an adequate pneumatic system (not detailed here) which is designed to urge the rear clamping bar RC towards a center portion of the cylinder pit 15*a*, 25*a*, thereby causing the printing plate to be tensioned. Such system may in particular include an inflatable pneumatic hose located between the rear clamping bar RC (conveniently mounted on a slide) and a wall portion of the cylinder pit 15*a*, resp. 25*a*, to selectively urge the rear clamping bar to its tensioning position. Adjustment of the pneumatic pressure applied to the inflatable pneumatic hose allows for an adjustment of the tensioning force applied by the rear clamping bar RC.

FIG. 4 is a schematic sectional view of the plate cylinder 15, 25 of FIG. 3 taken along section I-I in FIG. 3, where the front clamping bar FC, the adjusting elements 51, 52, the rear clamping bar RC, and the adjusting elements 61 to 64 are visible. Clamping devices 41, 42 are provided at the front clamping bar FC and rear clamping bar RC, respectively, to suitably clamp the leading end LP and trailing end TP of a printing plate. The operating principle of the clamping devices 41, 42 is inspired from the clamping devices disclosed in German patent applications Nos. DE 195 11 956 A1, DE 10 2005 061 453 A1 and DE 10 2005 061 460 A1 in the name of Koenig & Bauer AG. The structure of the clamping devices 41, 42 will not be detailed here and it suffices to understand that each clamping device 41, 42 comprises, in this example, a moveable clamping member 410, 420 that is designed to press against a lower side of the printing plate, when inserted in the corresponding clamping bar FC, RC, and clamp the relevant end of the printing plate against a fixed clamping member (not referenced) located above the associated moveable clamping member 410, 420. Various solutions may be contemplated in the context of the invention to achieve proper clamping of the leading and trailing ends of the printing plate, and the illustration of FIG. 4 is by no way limiting.

As mentioned above, the rear clamping bar RC is designed to be moveable in the circumferential direction toward an inner portion of the cylinder pit 15*a*, 25*a* (i.e. towards the right in FIG. 4) in order to tension the clamped printing plate. Such movement is preferably controlled pneumatically, by exerting pressure forcing the rear clamping bar RC to move and generate a corresponding tensioning force, which is applied to the printing plate from the trailing end TP thereof.

The rear clamping bar RC is suitably provided with a locking device 45 to allow the rear clamping bar RC to be mechanically locked in position onto the plate cylinder 15, 25. In this way, the rear clamping bar RC is only actively actuated (for instance pneumatically) when tensioning the printing plate and, once the rear clamping bar RC is appropriately positioned, the locking device 45 comes into play to mechanically lock the rear clamping bar RC in position, allowing the actuation force applied on the rear clamping bar during the tensioning procedure to be suppressed. It will however be appreciated that other solutions could be envisaged in order to lock or hold the rear clamping bar RC into position (see e.g. FIGS. 7*a* to 7*e*).

As this will be appreciated hereinafter, the above features of the plate clamping system are put into practice to achieve accurate mounting and tensioning of the printing plate on each plate cylinder 15, 25.

FIGS. 5*a* to 5*e* illustrate various stages of a plate clamping procedure according to a preferred embodiment of the invention whereby a printing plate, designated by reference P is clamped and mounted on the circumference of each plate cylinder 15. While FIGS. 5*a* to 5*e* illustrate the plate clamping procedure from the point of view of plate cylinders 15, it is to be appreciated that this procedure equally applies to the mounting and clamping of the printing plates on each plate cylinder 25.

Generally speaking, the printing plate (which is designated by reference P in the Figures) is first clamped at its leading end LP in the front clamping bar FC, then wrapped around the plate cylinder 15, 25, and finally clamped at its trailing end TP in the rear clamping bar RC, which procedure is generally illustrated by FIGS. 5*a* to 5*e*.

Tests carried out by the Applicant have shown that the initial step, namely the clamping of the leading end LP of the printing plate P in the front clamping bar FC is a particularly critical step as accurate positioning of the printing plate is greatly dependent on the way the printing plate P is clamped at its leading end LP. In accordance with a particularly preferred embodiment, clamping of the leading end LP of the printing plate P is performed as follows:

i. a rotational position of the plate cylinder 15, 25 is adjusted to match a defined rotational position for mounting of the printing plate (designated by reference P in the Figures);

ii. the front clamping bar FC of the plate cylinder 15, 25 is opened to receive the leading end LP of the printing plate P;

iii. the printing plate P is positioned with respect to the plate cylinder 15, 25 so that the leading end LP of the printing plate P exhibits a defined position and orientation with respect to the plate cylinder 15, 25 and the front clamping bar FC;

iv. the leading end LP of the printing plate P is inserted in the front clamping bar FC of the plate cylinder 15, 25; and v. the front clamping bar FC of the plate cylinder 15, 25 is closed, thereby clamping the leading end LP of the printing plate P.

Optionally, one or more underlays may be inserted between the circumference of the plate cylinder 15, 25 and the printing plate P after step v and before the printing plate P is wrapped around the circumference of the plate cylinder 15, 25.

Steps iv. and v. above are in particular carried out with the aid and assistance of the aforementioned register pins 31, 32 and register punch holes Pa, Pb so that proper register between the leading end LP of the printing plate P and the front clamping bar FC is guaranteed.

The above-listed steps are important in that they ensure that the printing plate P is positioned with respect to the plate cylinder 15, 25 and front clamping bar FC and inserted in the latter with as little influence from external factors as possible. In that respect, it is advantageous, in the context of the Simultan offset printing press shown in FIGS. 1A, 1B, 2, to carry out the above steps in the same way for all plate cylinders 15, 25 and provide that a position and orientation of each printing plate P with respect to the corresponding plate cylinder 15, 25, upon mounting of the printing plate P on the corresponding plate cylinder 15, 25, are the same for all printing plates P and plate cylinders 15, 25.

This is further facilitated and guaranteed, according to a particularly advantageous implementation of the invention, by the use of a printing plate cassette holder, designated by reference numeral 300 in FIGS. 5*a* to 5*e*, which printing plate cassette holder 300 contains the printing plate P to be wrapped onto the plate cylinder 15, 25 and is mounted next to the plate cylinder 15, 25 in a defined and repeatable way. Such printing plate cassette holder (or simply "cassette") 300 further has the advantage that a printing plate produced in the pre-press department can be temporarily stored in the cassette prior to mounting of the printing plate on the printing press. In this way, the printing plate can be protected and negative influences resulting from printing plate handling can be prevented. Preferably, the same cassette holder is used for all plate cylinders 15, 25.

The printing plate cassette holder 300 is schematically illustrated in FIGS. 5*a* to 5*e* and could take any appropriate shape and structure. While the printing plate cassette holder 300 is shown as being rectilinear in FIGS. 5*a* to 5*e*, it may for instance be contemplated to shape the cassette holder 300 in a curved manner so as to force the printing plate P to occupy a certain and defined position in the cassette holder 300, especially if this helps ensuring a defined positioning and insertion of the printing plate P in the front clamping bar FC. The cassette holder could furthermore be made of a single part or of two (or more) parts depending on ergonomic and handling requirements.

As illustrated in FIGS. 5*a* to 5*e*, a pressing roller 320 is further provided, which pressing roller 320 can be moved (for instance pivoted) from a non-working position (as shown for instance in continuous lines in FIGS. 5*a* and 5*b*) to a working position (as shown for instance in continuous lines in FIG. 5*d*) where the pressing roller 320 presses the printing plate P against the circumference of the plate cylinder 15, 25 during wrapping of the printing plate P around the plate cylinder. This pressing roller 320 can advantageously form a part of the printing plate cassette holder 300.

As a further refinement, it is advantageous to pre-bend the leading end LP and trailing end TP of the printing plate P prior to mounting of the printing plate P on the plate cylinder 15, 25. Bending of the leading and trailing ends LP, TP of the printing plates to defined bending angles favours a proper positioning and wrapping of the printing plate P on the plate cylinder 15, 25.

Figure 5A:
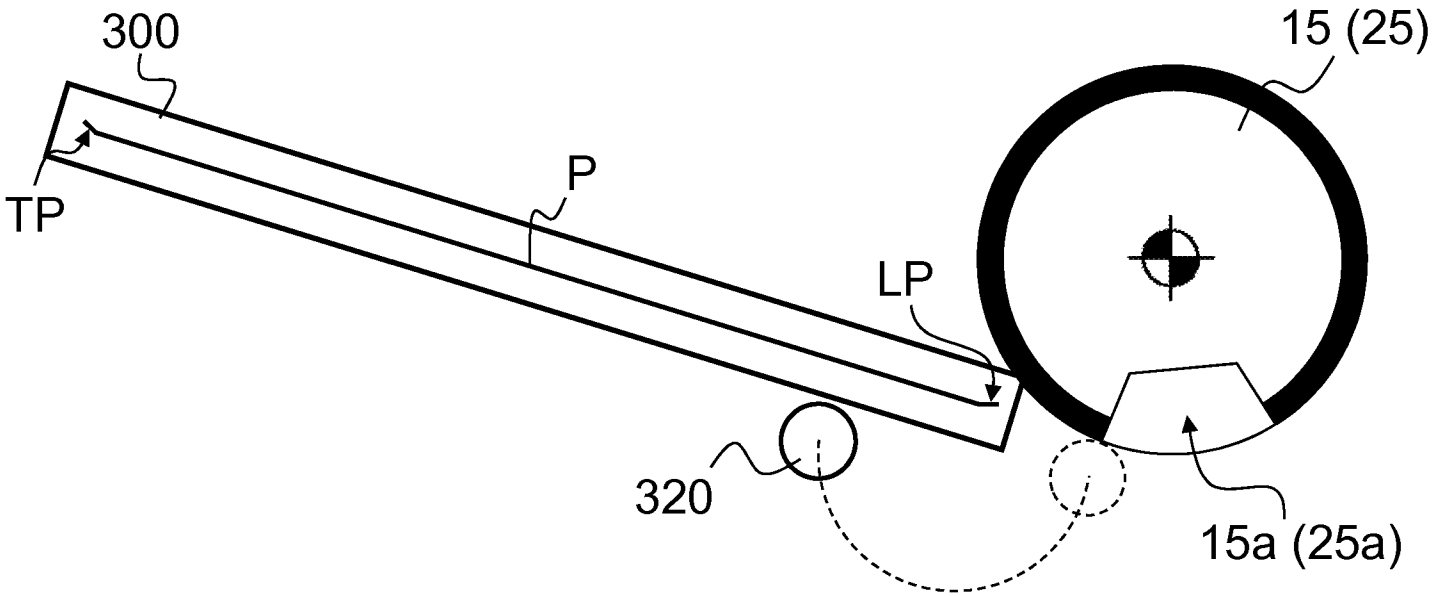
FIGS. 5*a* to 5*e* are schematic side views of a plate cylinder of the printing press and of an associated printing plate cassette holder, which side views illustrate various stages of a plate clamping procedure according to a preferred embodiment of the invention whereby a printing plate is clamped and mounted on the circumference of the plate cylinder.

FIG. 5*a* illustrates a possible positioning and orientation of the plate cylinder 15, 25, of the printing plate P and of the printing plate cassette holder 300 at the beginning of the plate clamping procedure. As illustrated, a rotational position of the plate cylinder 15, 25 is adjusted to correspond to the illustrated position, i.e. a defined position bringing the front clamping bar FC (not illustrated in FIGS. 5*a* to 5*e*) of the plate cylinder 15, 25 next to an output of the printing plate cassette holder 300 where the printing plate P is stored. The positioning and orientation of the printing plate P with respect to the plate cylinder 15, 25 and front clamping bar FC is such that the printing plate P is essentially aligned along a tangent to the circumference of the plate cylinder 15, 25 where the front clamping bar FC is located. In this position, the printing plate P is still held in the cassette holder 300 and the pressing roller 320 is in a retracted position.

Figure 5B:
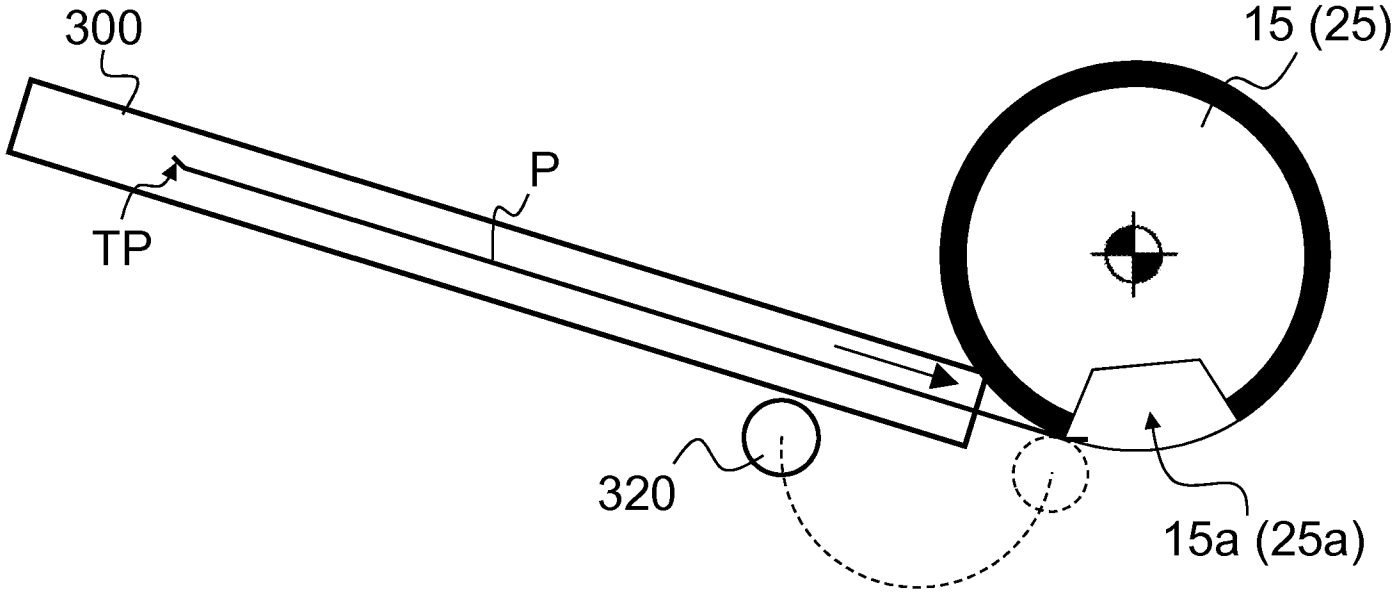
Figure 6A:
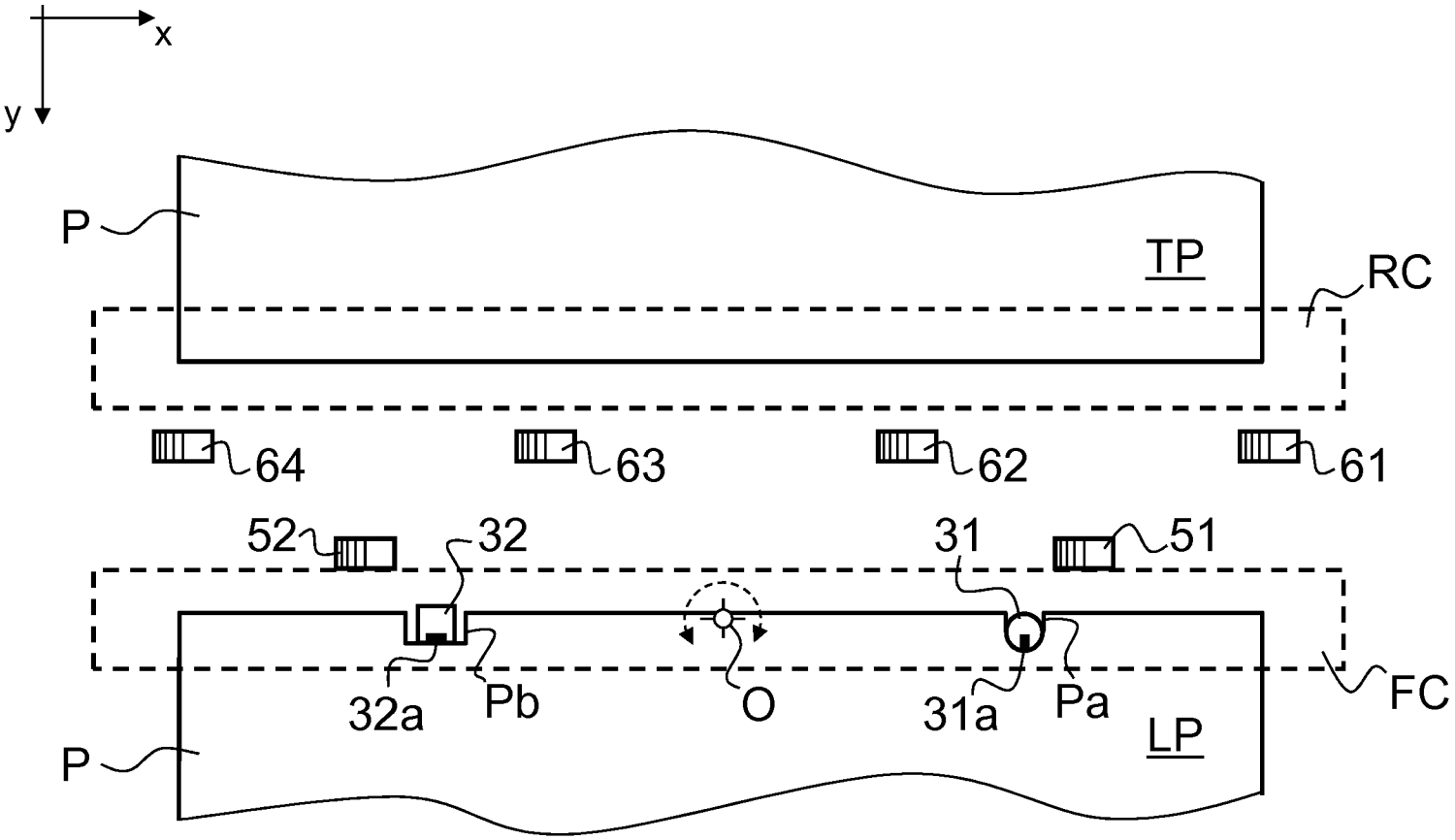
FIGS. 6*a* to 6*e* are schematic views illustrating the leading end and trailing end of a printing plate clamped in corresponding front and rear clamping bars, respectively, which views illustrate various stages of a plate tensioning procedure according to a first embodiment of the invention whereby a printing plate, which has been clamped and mounted on the circumference of the plate cylinder, is tensioned to achieve a desired, target print register.

FIG. 5*b* illustrates the insertion of the leading end LP of the printing plate P in the front clamping bar FC which is in an open position (i.e., referring to the illustration of FIG. 4, the clamping device 41 is actuated to lower the movable clamp member 410 and open the mouth of the front clamping bar FC). During this operation, the register punch holes Pa, Pb provided at the leading end LP of the printing plate P come in abutment with the register pins 31, 32 provided on the front clamping bar (as illustrated in FIG. 6*a*).

Preferably, insertion of the leading end LP of the printing plate P in the front clamping bar FC is performed with a view to position this leading end LP with a defined relative position with respect to the mouth of the front clamping bar FC, i.e. care is taken that the leading end LP of the printing plate P sits in a defined relative position with respect to the upper and lower portions of the mouth of the front clamping bar FC. It has indeed been noticed that the position of the leading end LP of the printing plate P in the mouth of the front clamping bar FC may have an effect on the way the printing plate P is clamped.

Figure 5C:
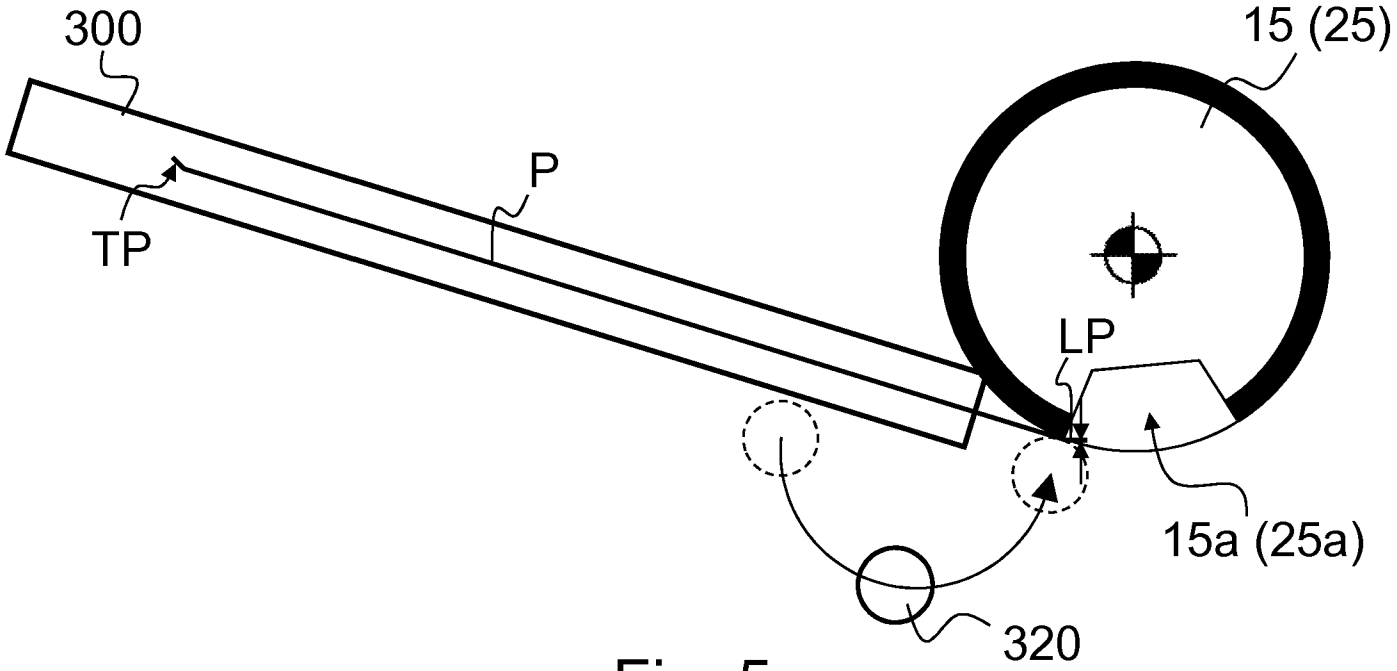

Once the leading end LP of the printing plate P has been properly inserted in the front clamping bar FC, the front clamping bar FC is closed as illustrated schematically by opposite arrows in FIG. 5*c*. The entire clamping bar may be closed at once. According to a variant of the invention, it may however be appropriate to control or design the clamping bar FC in such a way that closure starts from a central portion of the clamping bar FC and gradually progresses towards the sides. Once the front clamping bar FC is closed and the printing plate P is clamped at its leading end LP, the pressing roller 320 can be brought to its working position (either manually or semi-automatically), in contact with the circumference of the plate cylinder 15, 25.

Figure 5D:
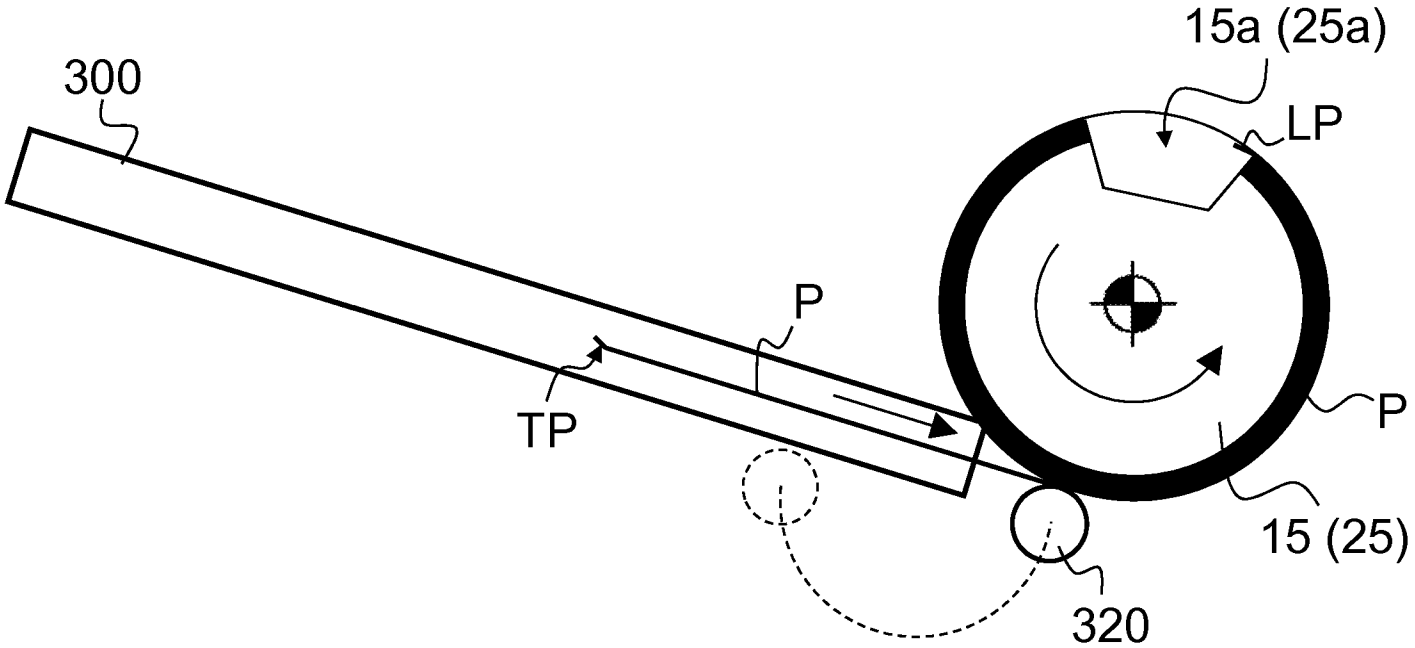

FIG. 5*d* illustrates the wrapping of the printing plate P around the circumference of the plate cylinder 15, 25, which wrapping is aided by the action of the pressing roller 320 that forces the printing plate to accurately follow the curvature of the plate cylinder 15, 25. This wrapping process can be fully automated, the printing press taking control of this step and ensuring that the printing plate P is wrapped under defined and repeatable conditions.

Figure 5E:
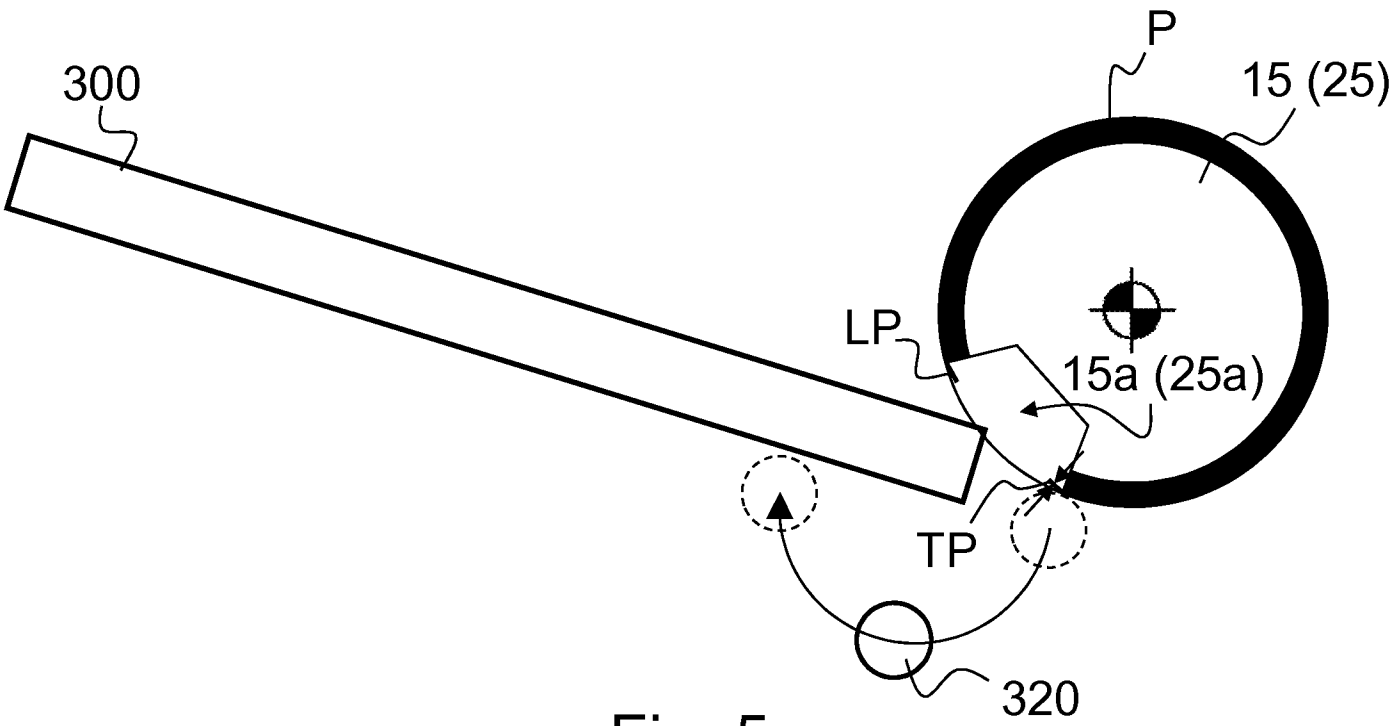

FIG. 5*e* illustrates the end of the wrapping operation upon which the rotation of the plate cylinder 15, 25 is stopped and the trailing end TP of the printing plate P is brought next to the location of the rear clamping bar RC (not illustrated in FIGS. 5*a* to 5*e*). Insertion of the trailing end TP of the printing plate P in the rear clamping bar RC is preferably done automatically, which automatic insertion may require the rear clamping bar RC to be moved to a retracted position (i.e. towards the center of the cylinder pit 15*a*, 25*a*) and allow the trailing end TP of the printing plate P to enter the opened mouth of the rear clamping bar upon complete wrapping of the printing plate P around the plate cylinder 15, 25. This automatic insertion of the trailing end TP of the printing plate P in the mouth of the rear clamping bar RC can be aided by the action of the pressing roller 320. Upon insertion of the trailing end TP of the printing plate P in the rear clamping bar RC, the latter can be closed, as depicted by opposing arrows in FIG. 5*e*, and the pressing roller 320 can be moved back to its retracted position.

Following the plate clamping procedure described above, the printing plate P is effectively clamped and wrapped around the plate cylinder 15, 25. The printing plate P however still needs to be put under tension and be adjusted so as to reach the desired target print register, i.e. accurate register between the various colours on each side of the printed material, as well as register between the patterns printed on both sides.

A plate tensioning procedure according to a first embodiment of the invention will now be described in reference to FIGS. 6*a* to 6*e*. This procedure is aimed at ensuring that a printing plate P, which has been clamped and mounted on the circumference of the plate cylinder 15, 25, is tensioned to achieve a desired target print register.

As mentioned hereinabove, print register is affected by and depends on a number of factors, including the printing press mechanics (gears, bearings, drives, etc.) and the printing plate per se. The printing plate material may play a rather considerable role in that context. The following plate tensioning procedure is aimed at ensuring that the printing plate is precisely and accurately positioned and tensioned to ensure proper print register from the leading to the trailing end of the print.

FIG. 6*a* is a schematic illustration of the leading end LP and trailing end TP of the printing plate P which is clamped (but not tensioned at this stage) between the front and rear clamping bars FC, RC. The adjusting elements 51, 52 and 61 to 64 that were discussed previously in reference to FIGS. 3 and 4 are also depicted.

In the illustration of FIG. 6*a*, the adjusting elements 61 to 64 are inactive, i.e. the rear clamping bar RC is free to move, over a limited range, along the circumference of the corresponding plate cylinder 15, 25, which allowable direction of displacement is parallel to axis y in FIG. 6*a*. In the illustration of FIG. 6*a*, the rear clamping bar RC occupies a so-called tension-release position.

Figure 6B:
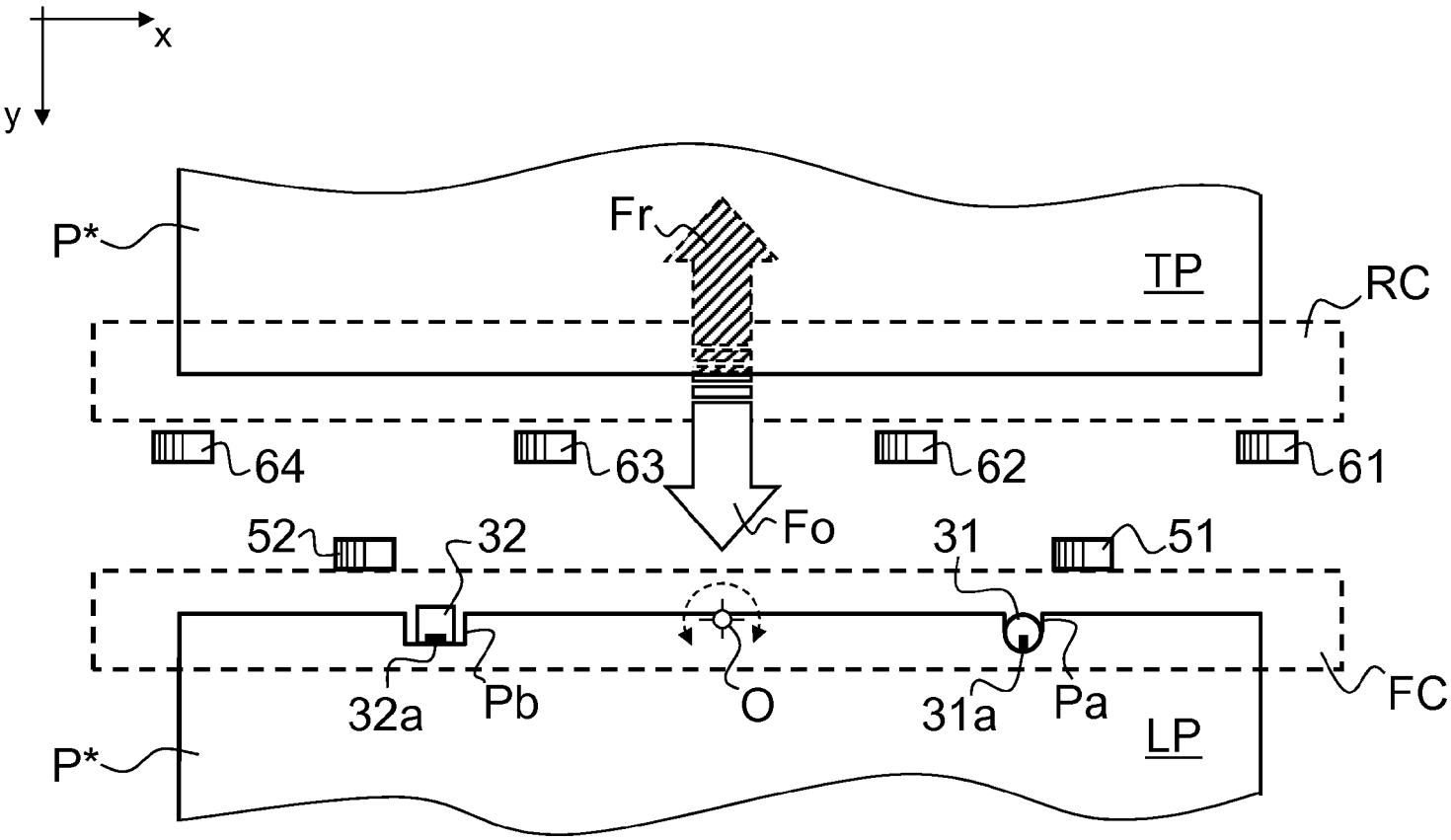

FIG. 6*b* illustrates a state where the rear clamping bar RC has been moved under the application of a nominal tensioning force (schematically illustrated by the white arrow indicated by reference Fo). As a result, the printing plate is put under tension (the tensioned plate being designated in such a case by reference P*). The rear clamping bar RC, which is free to move, is thereby displaced to a tensioning position (or "nominal tensioning position"). In the illustrated example, the nominal tensioning position corresponds to an equilibrium between the nominal tensioning force Fo applied to the rear clamping bar RC and the resulting reactive force Fr produced by the tensioned printing plate P* (such reactive force Fr being schematically illustrated by the dashed arrow in FIG. 6*b*).

As already mentioned hereinabove, tensioning of the printing plate P is preferably carried out pneumatically. In addition, it is highly advantageous to ensure that tensioning of the printing plate is performed by a rapid movement of the entire rear clamping bar RC which acts and applies a tensioning force over the whole width of the printing plate. The rapid movement of the rear clamping bar ensures that the tensioning force is appropriately distributed along the entire width and length of the printing plate P, leading to a uniform, and mostly elastic elongation of the printing plate P.

Once the equilibrium schematically illustrated in FIG. 6*b* has been reached, the rear clamping bar RC is locked in the nominal tensioning position. Referring to FIG. 4, mechanical interlocking of the rear clamping bar RC on the plate cylinder 15, 25 is performed by means of the locking device 45. Once locked onto the plate cylinder, the pneumatic pressure exerted on the rear clamping bar RC can be suppressed.

Figure 6C:
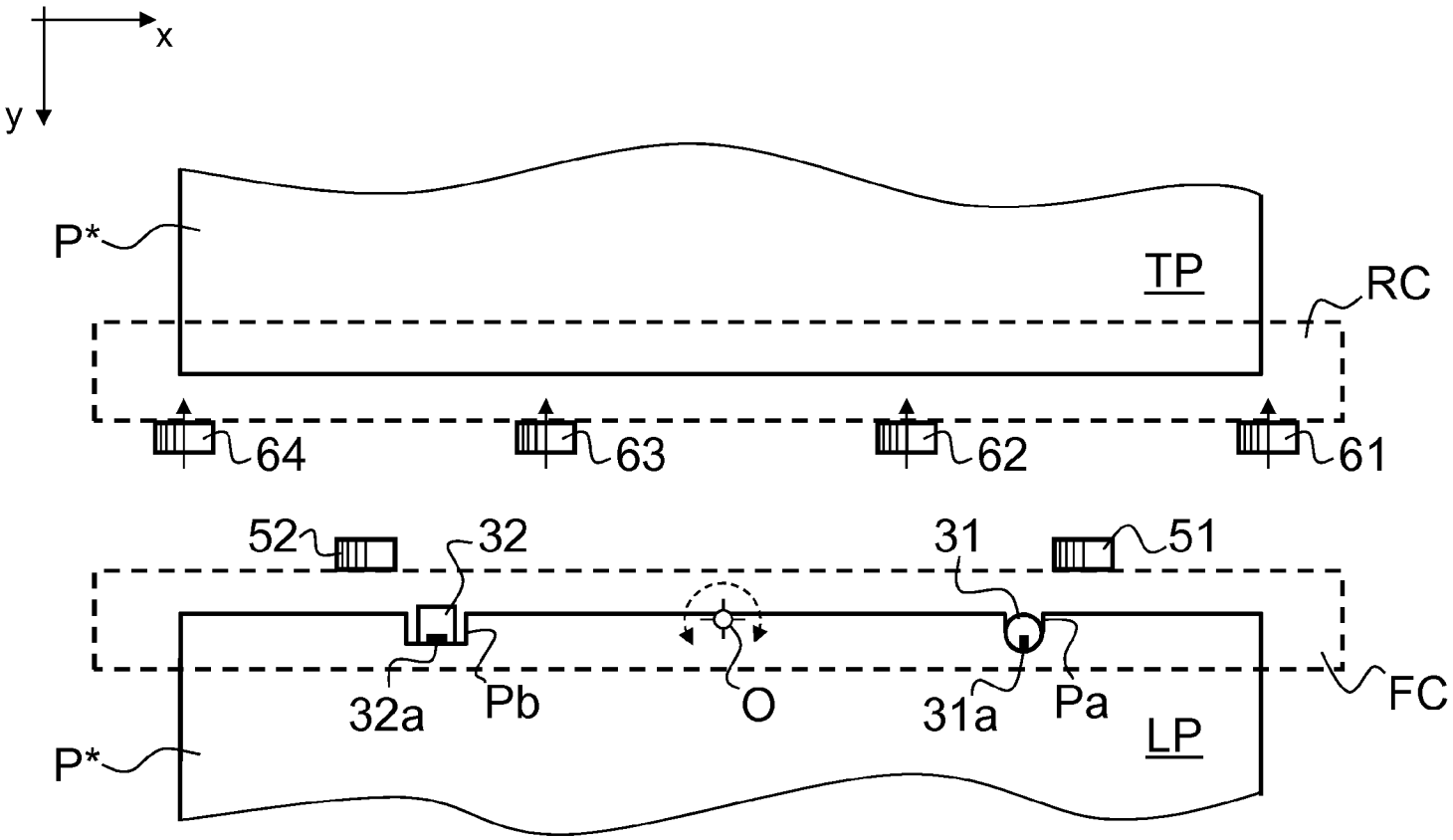

Next, as illustrated in FIG. 6*c*, the nominal tensioning position (which can be different for each printing plate P and each plate cylinder 15, 25) is set and stored as a reference position of the rear clamping bar RC. In this first example, such setting is done mechanically by moving the adjusting elements 61 to 64 in abutment against a rear wall portion of the rear clamping bar RC as schematically illustrated in FIG. 6*c*. The thus set reference position, stored as the respective positions of the adjusting elements 61 to 64, is used as reference to perform the necessary fine adjustments of the rear clamping bar RC.

Adjustment of the tensioning of the printing plate P first requires a suitable measurement of the print register of the tensioned printing plate P*. This can be done, once all printing plates have been clamped and tensioned on their corresponding plate cylinders, by printing sample sheets onto which the variations in print register can be assessed and measured. Appropriate measuring tools can be used to assist the operator in this operation.

Once the print register has been measured for each colour and each printing plate, and compared to a target print register, corrections can be determined, which corrections are translated into corresponding and necessary adjustments of the rear clamping bar RC. Generally speaking, if the measurements show that a printing length for a given printing plate is too short, then this can be translated into a corresponding adjustment of the position of the rear clamping bar RC forcing a longer elongation of the printing plate P. Conversely, if the measurements show that a printing length for a given printing plate is too long, then this can be translated into a corresponding adjustment of the position of the rear clamping RC forcing a shorter elongation of the printing plate P. These adjustments may obviously differ along the width of the printing plate. Therefore, corrections are determined at various locations along the width of the printing plate P and translated into corresponding adjustments to be made by way of the adjusting elements 61 to 64. In other words, a corrected tensioning position of the rear clamping bar RC corresponding to the target print register is determined.

Figure 6D:
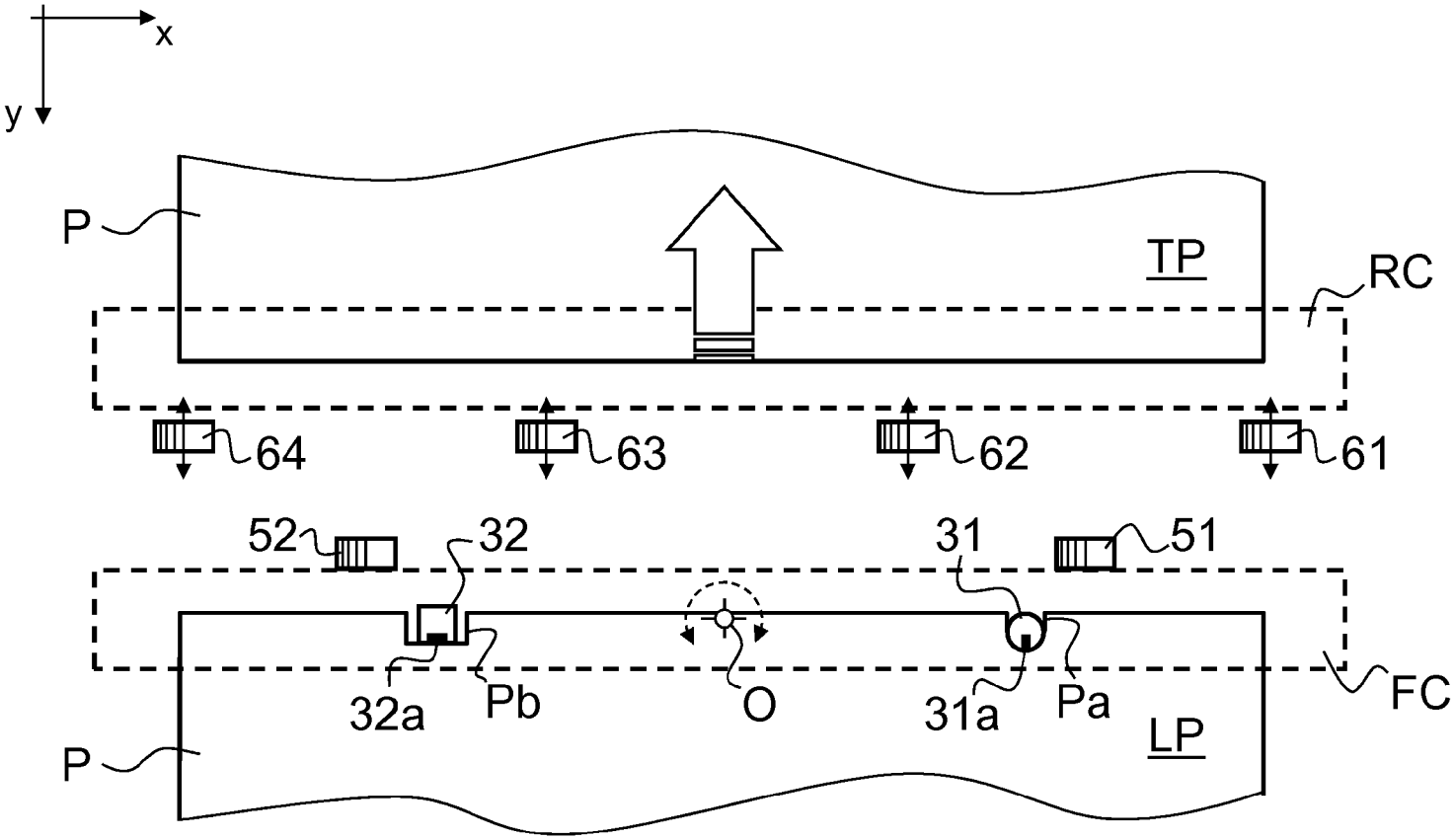

Before doing any adjustment of the position of the rear clamping bar RC, the printing plate P is however returned to a non-tensioned state, as schematically illustrated in FIG. 6*d*. This is done by unlocking and moving the rear clamping bar RC to a tension-release position. After this has been done, the previously-determined corrected tensioning position of the rear clamping bar RC can be set as new reference, in this case by means of the adjusting elements 61 to 64.

Figure 6E:
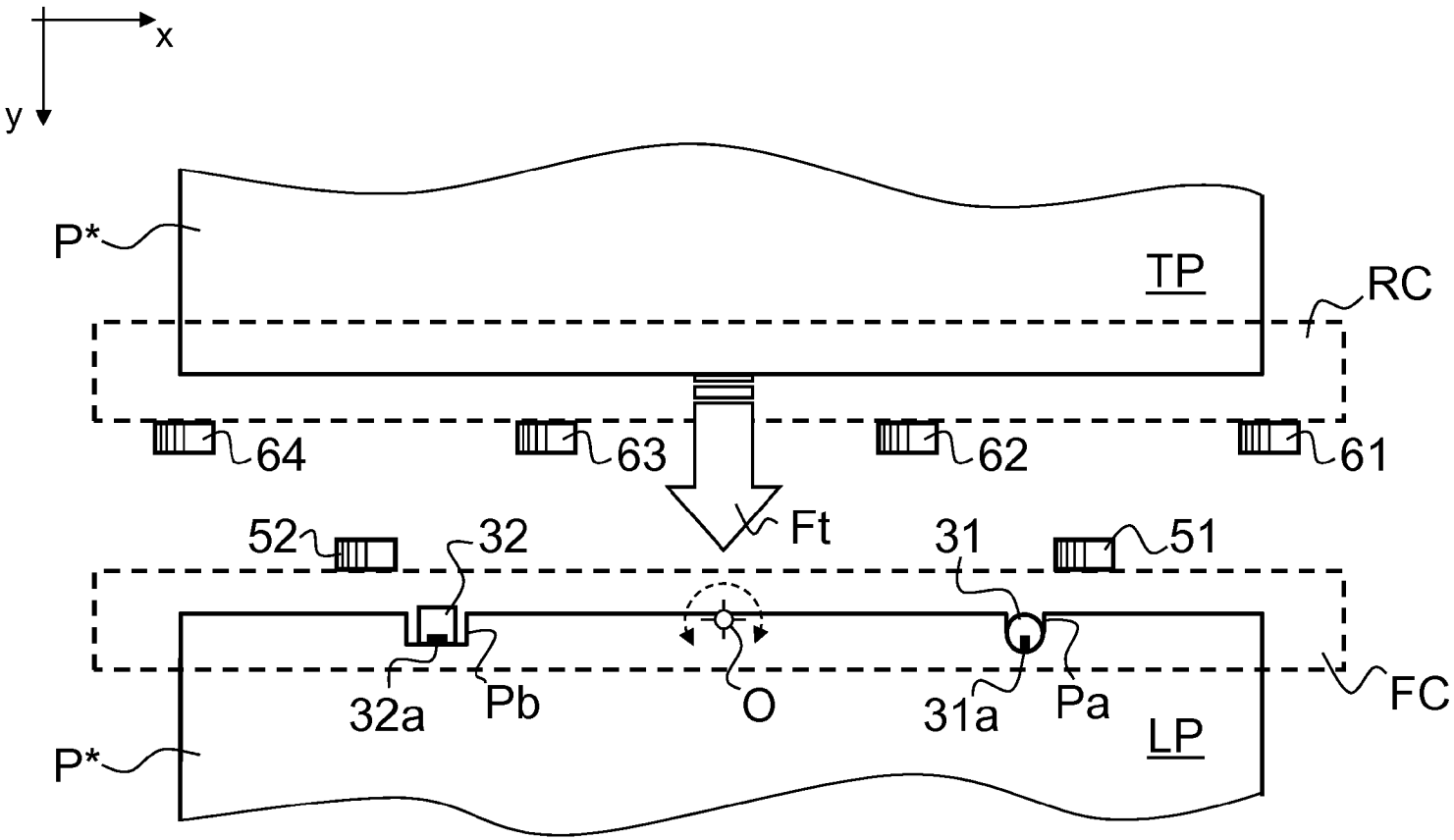

Once the necessary corrections have been made, the printing plate is tensioned again by applying a tensioning force Ft to the rear clamping bar RC, thereby causing the rear clamping bar RC to move to the new reference position as illustrated by FIG. 6*e*. In this case, and in contrast to the initial tensioning operation of FIG. 6*b*, the printing plate P is tensioned until the rear clamping bar RC comes in abutment against the adjusting elements 61 to 64. The tensioning force Ft applied in this case may be different from the nominal tensioning force Fo applied initially. In particular, if the corrections to be made require the printing plate P to be elongated further than the nominal elongation (i.e. in case the print is too short), then the tensioning force Ft must be increased as compared to the nominal tensioning force Fo. Conversely, if the corrections to be made require a shorter elongation of the printing plate P as compared to the nominal elongation (i.e. in case the print is too long), then the tensioning force Ft can be less that the nominal tensioning force Fo. All-in-all, the tensioning force Ft applied must be sufficient to reliably force the rear clamping bar RC to come in abutment with the adjusting elements 61 to 64.

Once the tensioning of the printing plate P is carried out, the rear clamping bar RC can be locked in the new tensioning position. Referring again to FIG. 4, such locking can be performed by means of the locking device 45. Once locked onto the plate cylinder, the pneumatic pressure exerted on the rear clamping bar RC can likewise be suppressed.

Assuming that the adjustments have been properly made for all printing plates, the printing press shall be correctly set up to achieve the desired target print register. This being said, the above procedure can be repeated by again measuring the print register of the tensioned printing plate P* and determining if corrections are still required, in which case the same procedure as described above is followed. The relevant correcting steps can be repeated until the measured print register matches the target print register.

An alternate plate tensioning procedure according to a second embodiment of the invention will now be described in reference to FIGS. 7*a* to 7*e*. This procedure, like the previous procedure described in reference to FIGS. 6*a* to 6*e*, is also aimed at ensuring that a printing plate P, which has been clamped and mounted on the circumference of the plate cylinder 15, 25 is tensioned to achieve a desired target print register.

In contrast to the embodiment of FIGS. 6*a* to 6*e*, this second embodiment makes use of a plate clamping system with a rear clamping bar RC equipped with a different set of adjusting elements, designated by reference numerals 71 to 74 in FIGS. 7*a* to 7*e*. In the embodiment of FIGS. 6*a* to 6*e*, the adjusting elements are provided in such a way as to cooperate with a rear wall portion of the rear clamping bar RC, a reference position of the rear clamping bar RC being defined by the abutment of the rear wall portion of the rear clamping bar RC against the adjusting elements 61 to 64. In the example of FIGS. 7*a* to 7*e*, the adjusting elements 71 to 74 are advantageously mounted on the rear clamping bar RC itself and are designed as screw elements with a threaded portion 71*a* to 74*a* acting as adjusting member extending through the rear clamping bar RC for cooperation with a reference wall of the cylinder pit 15*a*, respectively 25*a*, of the plate cylinder 15, resp. 25, within which the plate clamping system is installed. In FIGS. 7*a* to 7*e*, this reference wall is schematically illustrated by a dash lines designated by reference numeral 70.

Figure 7A:
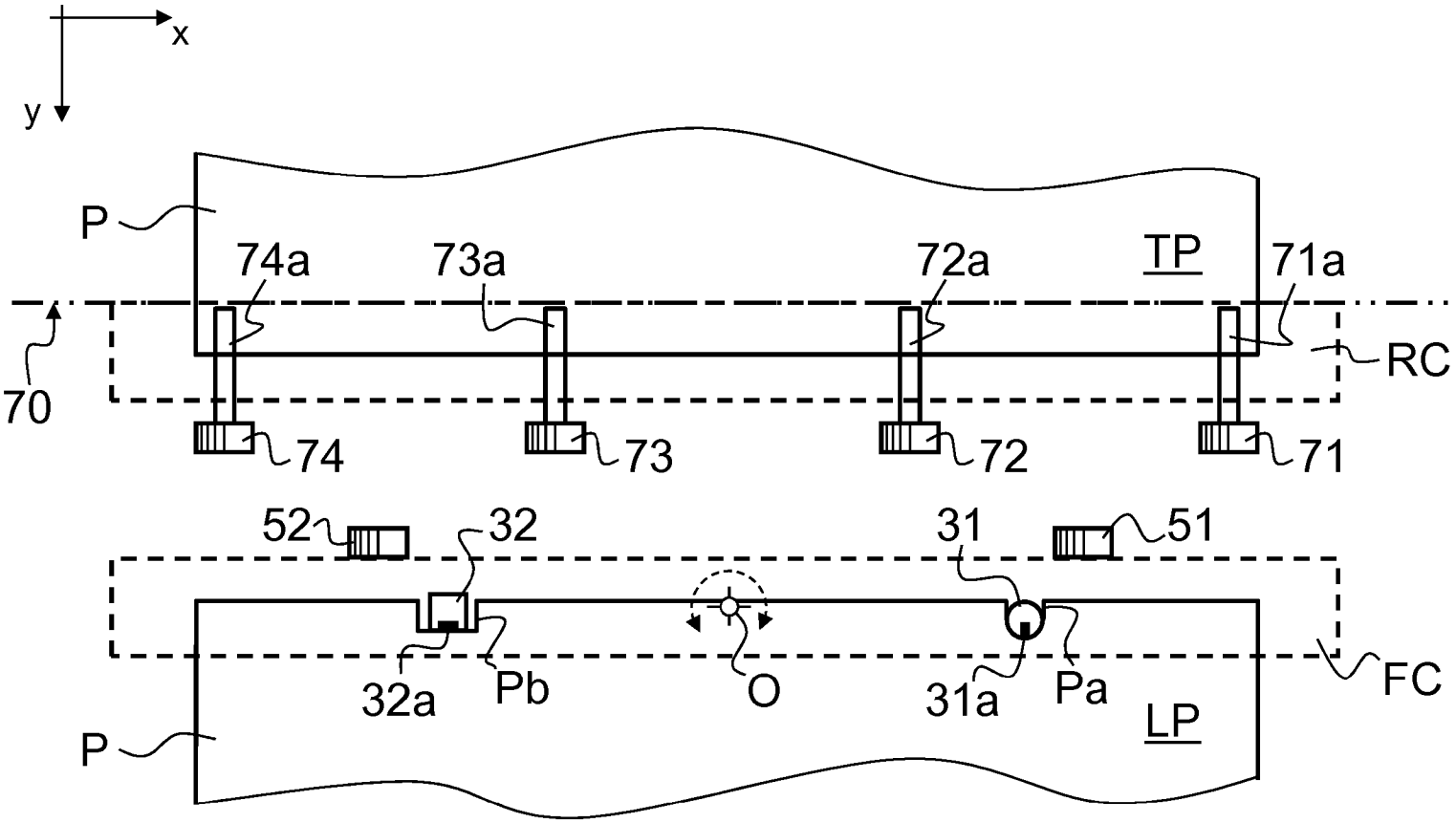
FIGS. 7*a* to 7*e* are schematic views illustrating the leading end and trailing end of a printing plate clamped in corresponding front and rear clamping bars, respectively, which views illustrate various stages of a plate tensioning procedure according to a second embodiment of the invention whereby a printing plate, which has been clamped and mounted on the circumference of the plate cylinder, is tensioned to achieve a desired, target print register.

FIG. 7*a* is a schematic illustration of the leading end LP and trailing end TP of the printing plate P which is clamped (but not tensioned at this stage) between the front and rear clamping bars FC, RC. The configuration of the front clamping bar FC, including the adjusting elements 51, 52, as well as the arrangement of the register pins 31, 32 is similar to what has already been described hereinabove.

In the illustration of FIG. 7*a*, the adjusting elements 71 to 74 are inactive (or in a "zero position"), i.e. the rear clamping bar RC, which is not under tension, is normally resting against the wall 70 (acting as reference wall) of the cylinder pit 15*a*, resp. 25*a*. The rear clamping bar RC is free to move away from the reference wall 70, during a tensioning operation, over a limited range, along the circumference of the corresponding plate cylinder 15, 25, which allowable direction of displacement is again parallel to axis y in FIG. 7*a*. In the illustration of FIG. 7*a*, the rear clamping bar RC occupies a so-called tension-release position.

Figure 7B:
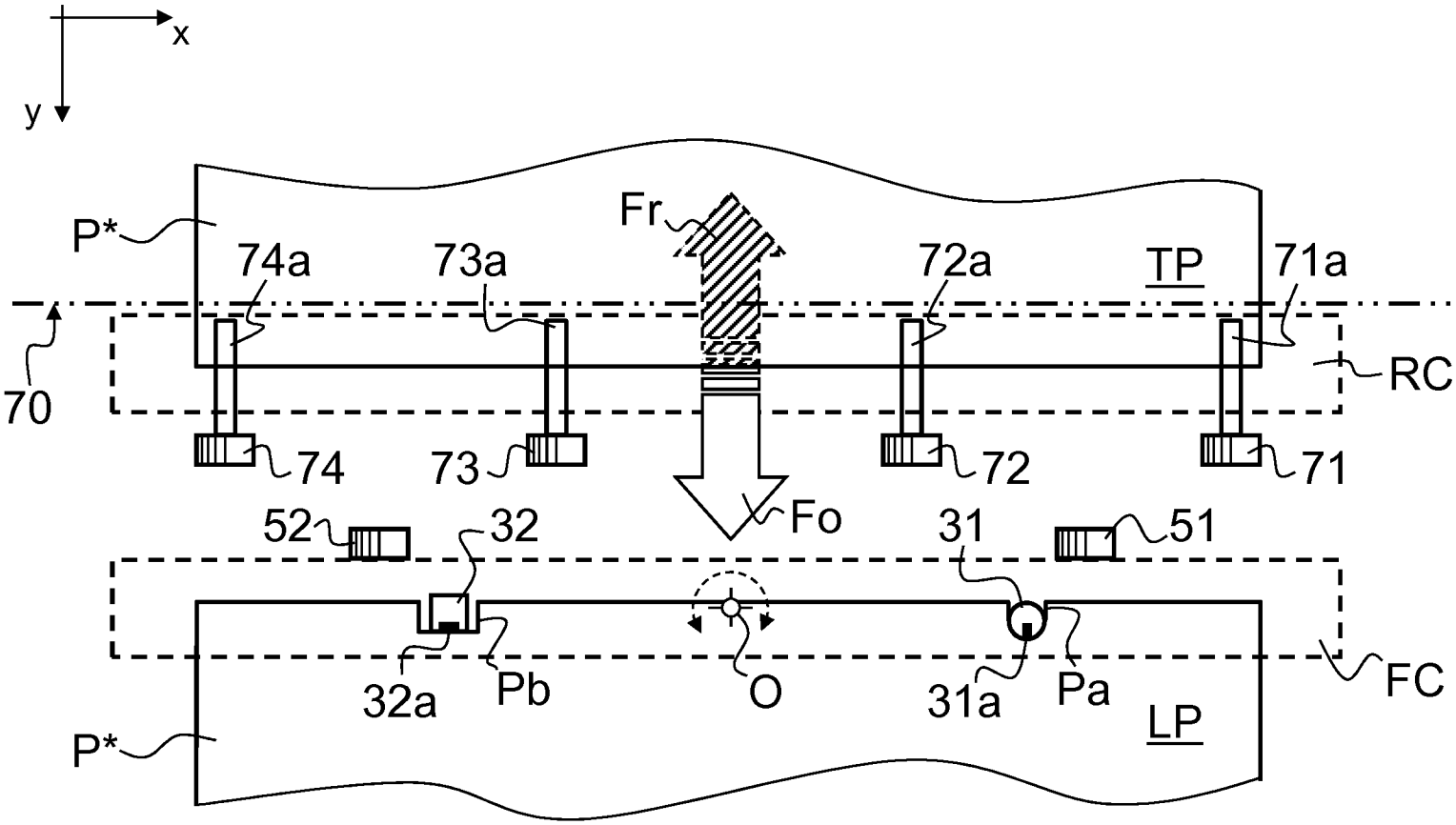

FIG. 7*b* illustrates a state where the rear clamping bar RC has been moved under the application of a nominal tensioning force (schematically illustrated by the white arrow indicated by reference Fo). As a result, the printing plate is put under tension (the tensioned plate being designated in such a case by reference P*). The rear clamping bar RC, which is free to move, is thereby displaced to a tensioning position (or "nominal tensioning position"). In the example illustrated in FIG. 7*b* (like in the example illustrated in FIG. 6*b*), the nominal tensioning position corresponds to an equilibrium between the nominal tensioning force Fo applied to the rear clamping bar RC and the resulting reactive force Fr produced by the tensioned printing plate P* (such reactive force Fr being schematically illustrated by the dashed arrow in FIG. 7*b*).

Like in the first embodiment discussed hereinabove, tensioning of the printing plate P is preferably carried out pneumatically. It is likewise highly advantageous to ensure that tensioning of the printing plate is performed by a rapid movement of the entire rear clamping bar RC which acts and applies a tensioning force over the whole width of the printing plate. The rapid movement of the rear clamping bar again ensures that the tensioning force is appropriately distributed along the entire width and length of the printing plate P, leading to a uniform, and mostly elastic elongation of the printing plate P.

Figure 7C:
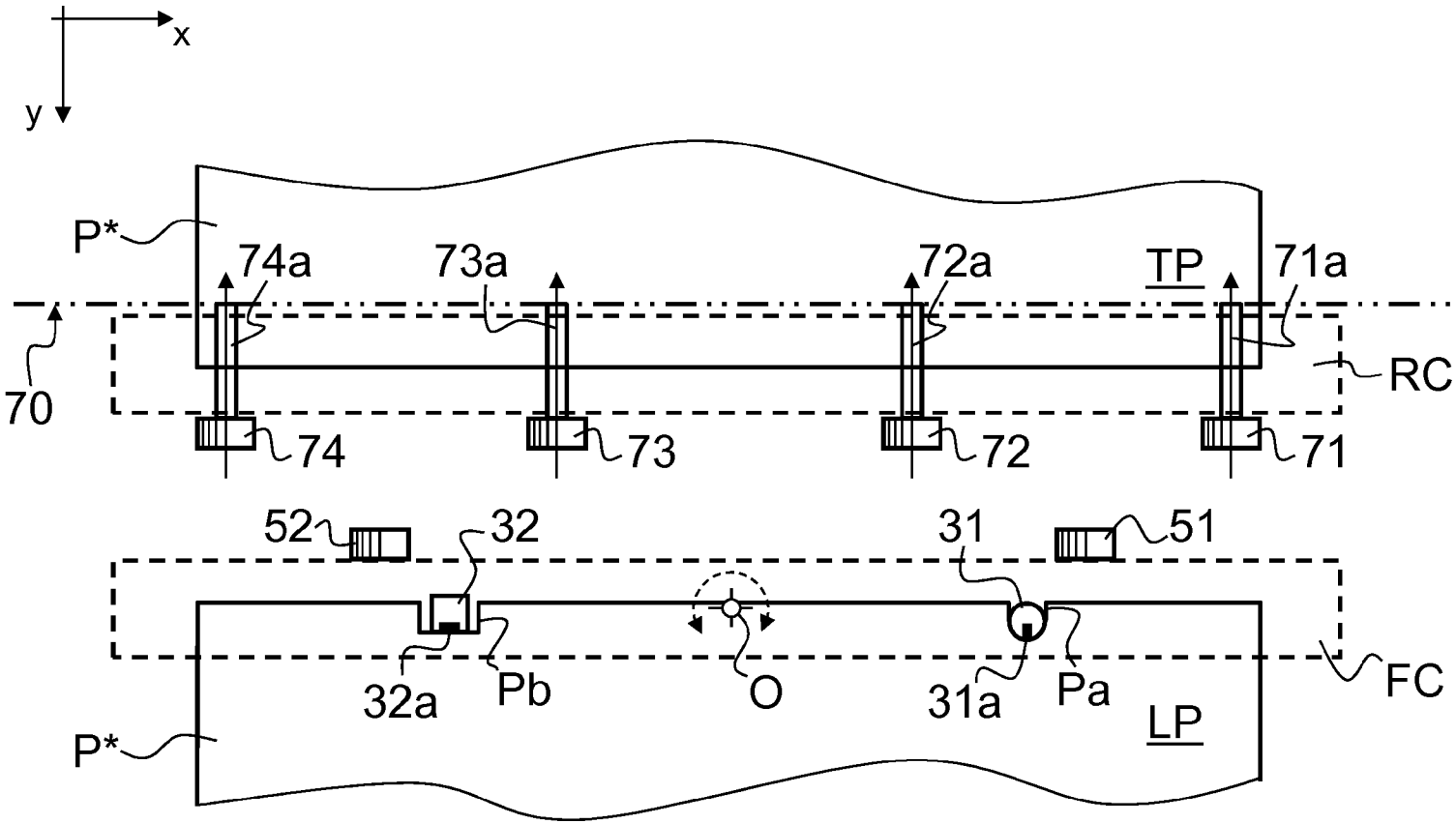

Once the equilibrium schematically illustrated in FIG. 7*b* has been reached, the rear clamping bar RC is held in this nominal tensioning position. This is performed, as illustrated by FIG. 7*c*, by moving the adjusting elements 71 to 74 so that the adjusting members 71*a* to 74*a* thereof come in abutment with the reference wall 70. In contrast to the first embodiment, it will therefore be appreciated that the rear clamping bar RC is not locked on the plate cylinder 15, 25 by means of a dedicated locking device, but held in position thanks to the adjusting elements 71 to 74 which come to rest against the reference wall 70. Once the adjusting elements 71 to 74 have been moved in abutment with the reference wall 70, the pneumatic pressure exerted on the rear clamping bar RC can be suppressed.

The nominal tensioning position (which can be different for each printing plate P and each plate cylinder 15, 25), as defined by the position of the adjusting elements 71 to 74, is set and stored as a reference position of the rear clamping bar RC. In this second embodiment, the position of each adjusting element 71 to 74 is in particular stored for subsequent correction and fine adjustment of the position of the rear clamping bar RC.

A suitable measurement of the print register of the tensioned printing plate P* is then carried out once all printing plates have been clamped and tensioned on their corresponding plate cylinders, as in the aforementioned first embodiment, i.e. by printing sample sheets onto which the variations in print register can be assessed and measured. Appropriate corrections of the position of the rear clamping bar RC, which translate into corresponding positional adjustments of the adjusting elements 71 to 74 are derived from these measurements of the print register. In other words, a corrected tensioning position of the rear clamping bar RC corresponding to the target print register is determined.

Figure 7D:
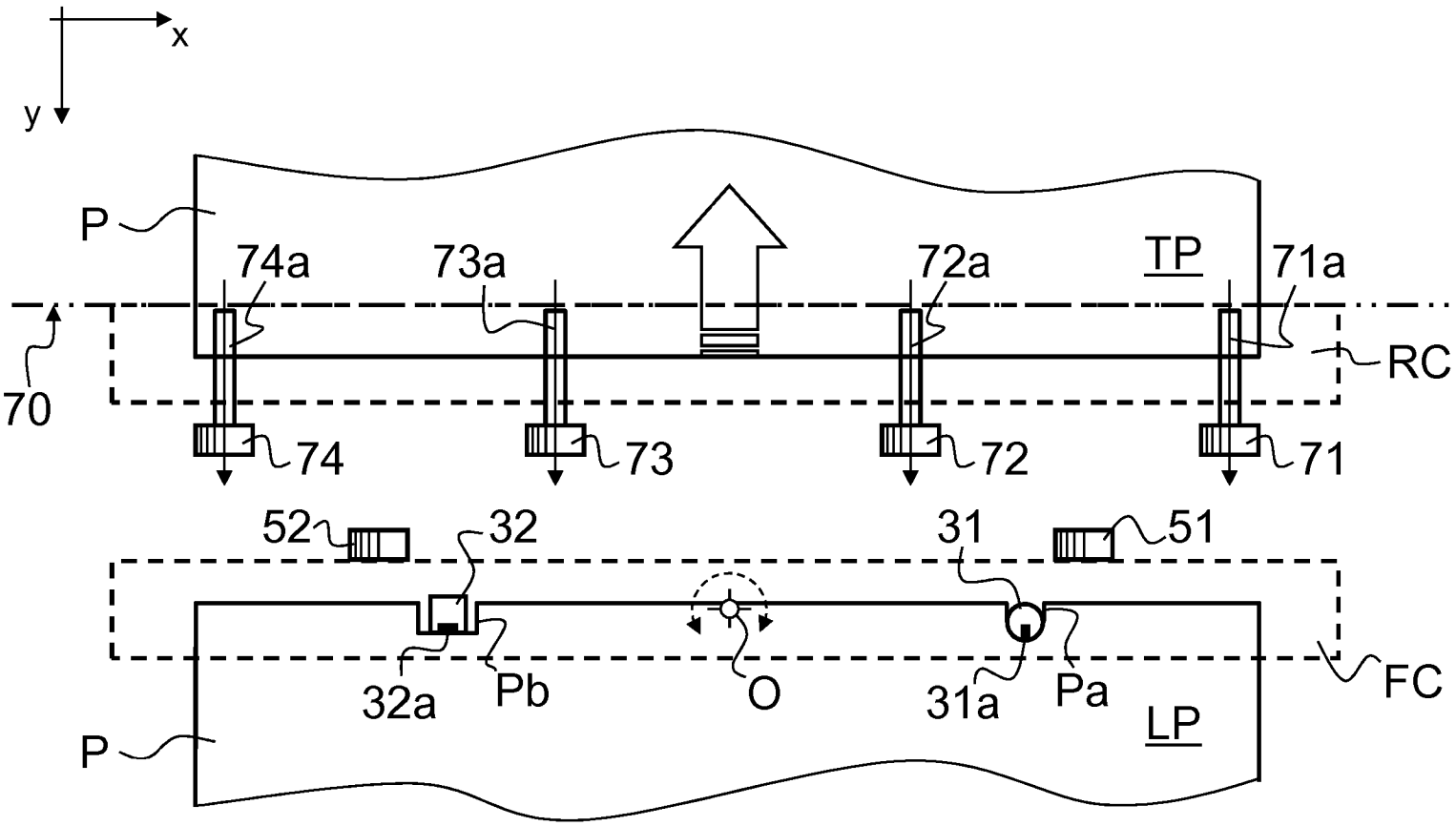

Before doing any adjustment of the position of the rear clamping bar RC, the printing plate P is however returned to a non-tensioned state, as schematically illustrated in FIG. 7*d*. This is done by first activating the pneumatic system, moving the adjusting elements 71 to 74 back to a "zero positions" (the reference positions thereof having been previously stored as mentioned above), thereby freeing the rear clamping bar RC and allowing it to move back to its tension-release position upon suppressing the pneumatic pressure exerted on the rear clamping bar RC.

Figure 7E:
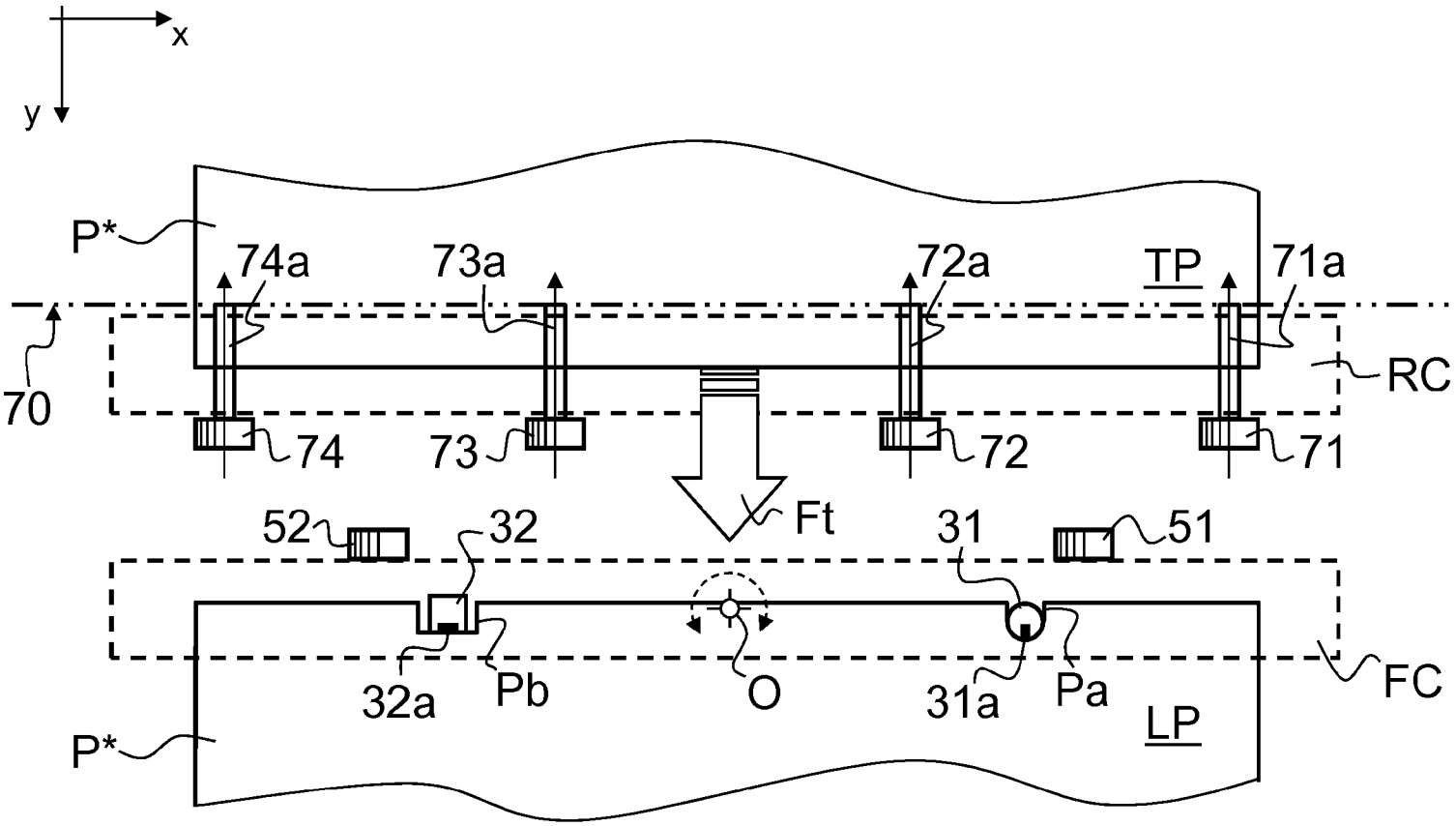

In contrast to the first embodiment discussed in relation to FIGS. 6*a* to 6*e*, corrections of the position of the rear clamping bar RC have to be performed, in this second embodiment, after the printing plate is tensioned again. As schematically illustrated in FIG. 7*e*, the printing plate is accordingly tensioned by applying a tensioning force Ft to the rear clamping bar RC, which tensioning force Ft is normally greater than the initial nominal tensioning force Fo in order to allow adjustment of the position of the rear clamping bar RC (unless a shorter elongation of the printing plate P is required after correction as compared to the nominal elongation). This causes the rear clamping bar RC to move to a correcting position (i.e. a tensioning position allowing correction and adjustment of the position of the adjusting elements 71 to 74). The adjusting elements 71 to 74 are then moved to their corrected tensioning positions which have been previously determined. Once this has been done, the pneumatic pressure exerted on the rear clamping bar RC can be suppressed, thereby causing the rear clamping bar RC to come to rest against the reference wall 70 via the position-corrected adjusting elements 71 to 74. As a result, the rear clamping bar RC is held in a corrected tensioning position acting as the new reference position of the clamping bar RC.

Assuming again that the adjustments have been properly made for all printing plates, the printing press shall be correctly set up to achieve the desired target print register. This being said, the above procedure can likewise be repeated by again measuring the print register of the tensioned printing plate P* and determining if corrections are still required, in which case the same procedure as described above in reference to FIGS. 7*a* to 7*e* is followed. The relevant correcting steps can be repeated until the measured print register matches the target print register.

Various modifications and/or improvements may be made to the above-described embodiments of the invention without departing from the scope of the invention as defined by the annexed claims.

For instance, it may be advantageous to further provide for the determination of a cylinder roundness profile of each plate cylinder 15, 25, which cylinder roundness profile is unique to each plate cylinder 15, 25 and depends on mechanical characteristics of the plate cylinder 15, 25 and of its mounting and driving in the printing press, and to image the printing image on the printing plate P based on (or with consideration of) the cylinder roundness profile of the plate cylinder 15, 25 onto which the printing plate P is to be mounted. Here, it is in particular intended to possibly eliminate eventual non-uniformities in the way the plate cylinder rotates by compensating such non-uniformities during the printing plate origination, i.e. by adjusting the printing image to counteract these non-uniformities.

The invention claimed is:

1. A method of mounting and adjusting printing plates on plate cylinders of a multicolour offset printing press, the method comprising the following steps:

a) clamping a leading end of a printing plate in a front clamping bar of one of the plate cylinders;

b) wrapping the printing plate around the circumference of the plate cylinder;

c) clamping a trailing end of the printing plate in a rear clamping bar of the plate cylinder, which rear clamping bar is movable under the application of a tensioning force and which rear clamping bar occupies, during the clamping of the trailing end of the printing plate in the rear clamping bar, a tension-release position;

d) tensioning the printing plate by applying a nominal tensioning force to the rear clamping bar, thereby causing the rear clamping bar to move from the tension-release position to a nominal tensioning position;

e) setting and storing the nominal tensioning position as a reference position of the rear clamping bar;

f) measuring a print register of each tensioned printing plate once all of the printing plates have been clamped and tensioned on their corresponding plate cylinders;

g) comparing the measured print register of each tensioned printing plate with a target print register and determining a corrected tensioning position of the rear clamping bar corresponding to the target print register for each printing plate;

h) releasing the tension of the printing plate;

i) setting the previously-determined corrected tensioning position as a new reference position of the rear clamping bar one of before and after tensioning again the printing plate; and j) if necessary, repeating steps f) to i) until the measured print register matches the target print register.

2. The method as defined in claim 1, wherein step i) includes setting the previously-determined corrected tensioning position as a new reference position of the rear clamping bar before tensioning again the printing plate by applying a tensioning force to the rear clamping bar thereby causing the rear clamping bar to move to the new reference position.

3. The method as defined in claim 2, further comprising the step of locking the rear clamping bar in position onto the plate cylinder following tensioning of the printing plate at steps d) and i) and unlocking the rear clamping bar before releasing the tension of the printing plate at step h).

4. The method as defined in claim 1, wherein setting of the reference position of the rear clamping bar at steps e) and i) is performed by means of two or more, preferably four, adjusting elements against which the rear clamping bar abuts.

5. The method as defined in claim 1, wherein step i) includes tensioning again the printing plate by applying a tensioning force to the rear clamping bar thereby causing the rear clamping bar to move to a correcting position before setting the previously-determined corrected tensioning position as new reference position of the rear clamping bar.

6. The method as defined in claim 5, further comprising the step of holding the rear clamping bar in position onto the plate cylinder upon setting of the reference position of the rear clamping bar at steps e) and i) and freeing the rear clamping bar before releasing the tension of the printing plate at step h).

7. The method as defined in claim 1, wherein setting of the reference position of the rear clamping bar at steps e) and i) is performed by means of two or more, preferably four, adjusting elements mounted on the rear clamping bar, which adjusting elements cooperate with a reference wall of the plate cylinder.

8. The method as defined in claim 4, wherein the adjusting elements are remote-adjustable motorized adjusting elements, such as motorized screw elements.

9. The method as defined in claim 1, wherein tensioning of the printing plate is performed by a rapid movement of the entire rear clamping bar of the plate cylinder, which rear clamping bar acts and applies a tensioning force over the whole width of the printing plate.

10. The method as defined in claim 1, wherein tensioning of the printing plate is carried out pneumatically.

11. The method as defined in claim 1, wherein the nominal tensioning position is a position corresponding to an equilibrium between the nominal tensioning force applied to the rear clamping bar and the resulting reactive force produced by the tensioned printing plate.

12. The method as defined in claim 1, further including pre-bending of the leading end and trailing end of the printing plate prior to mounting of the printing plate on the plate cylinder, the leading end and trailing end of the printing plate each exhibiting a defined bending angle.

13. The method as defined in claim 12, wherein the rear clamping bar is moved to a retracted position allowing the trailing end of the printing plate to enter a mouth of the rear clamping bar upon complete wrapping of the printing plate around the plate cylinder.

14. The method as defined in claim 1, further comprising, prior to mounting of the printing plate on the plate cylinder, the steps of:

determining a cylinder roundness profile of the plate cylinder, which cylinder roundness profile is unique to the plate cylinder and depends on mechanical characteristics of the plate cylinder and of its mounting and driving in the printing press; and imaging a printing image on the printing plate based on the cylinder roundness profile of the plate cylinder onto which the printing plate is to be mounted.

15. The method as defined in claim 1, wherein the multicolour offset printing press is of the type comprising multiple plate cylinders transferring inks to a common blanket cylinder, and wherein steps a) to j) are carried out for each plate cylinder.

* * * * *